US009187924B1

(12) United States Patent
Jackson et al.

(10) Patent No.: US 9,187,924 B1
(45) Date of Patent: Nov. 17, 2015

(54) HOOP HOUSE ANCHORING SYSTEM AND KIT

(75) Inventors: Carlton Jackson, Lyndhurst, OH (US); Christopher Todd Alexander, Cleveland, OH (US); Michael Walton, South Euclid, OH (US)

(73) Assignee: Tunnel Vision Hoops, LLC, Shaker Heights, OH (US)

( * ) Notice: Subject to any disclaimer, the term of this patent is extended or adjusted under 35 U.S.C. 154(b) by 393 days.

(21) Appl. No.: 13/620,417

(22) Filed: Sep. 14, 2012

Related U.S. Application Data

(60) Provisional application No. 61/535,503, filed on Sep. 16, 2011.

(51) Int. Cl.
*E04H 15/36* (2006.01)
*E04H 6/02* (2006.01)

(52) U.S. Cl.
CPC . *E04H 15/36* (2013.01); *E04H 6/02* (2013.01)

(58) Field of Classification Search
CPC ..... E04H 6/02; E04H 6/025; E04H 6/04; E04H 15/36; A01G 9/16
USPC ..... 135/118, 120.3, 129, 137, 116
See application file for complete search history.

(56) References Cited

U.S. PATENT DOCUMENTS 3,008,557 A * 11/1961 Clevett, Jr. ..... 52/166
3,203,143 A * 8/1965 Swenson ..... 52/64
3,480,023 A * 11/1969 McConnell et al. ..... 135/125
3,749,107 A * 7/1973 Laberge ..... 135/137
3,957,069 A * 5/1976 Denaro ..... 135/118
4,091,584 A * 5/1978 Brown ..... 135/127
4,402,166 A * 9/1983 Wortham, Jr. ..... E04H 12/223 248/156
4,404,980 A * 9/1983 Wade ..... 135/123
5,515,656 A * 5/1996 Mihalich ..... 52/155
5,598,668 A * 2/1997 Isom ..... 52/86
5,660,002 A * 8/1997 Lashinger ..... 52/63
5,740,827 A * 4/1998 Swarringim ..... 135/118
6,098,335 A * 8/2000 Brown, Jr. ..... 47/17
6,220,263 B1 * 4/2001 Randmae ..... 135/87
6,397,774 B1 * 6/2002 Pranger ..... 114/263
6,502,593 B1 * 1/2003 Stafford ..... 135/115
7,654,277 B1 * 2/2010 Brewer et al. ..... 135/124
8,479,757 B2 * 7/2013 Zhou ..... 135/118
2012/0117866 A1 5/2012 Garbos
2013/0125946 A1 * 5/2013 Bourdon ..... 135/121

OTHER PUBLICATIONS

"4H Poultry: Movable Poultry Hoop House," Retrieved at <<http://www.oardc.ohio-state.edu/4hpoultry/t02_pageview/Hoop_House_htm>>, Retrieved on Sep. 14, 2012, pp. 1-3.

(Continued)

*Primary Examiner* — Noah Chandler Hawk
(74) *Attorney, Agent, or Firm* — Medley, Behrens & Lewis, LLC

(57) ABSTRACT

An anchoring system for a hoop house includes a horizontal member. The horizontal member includes an anchor connector and a hoop connector. An anchor can be removably affixed to the anchor connector of the horizontal member. Moreover, an end of a hoop can be connected to the hoop connector. The anchor can include an attachment member that defines a non-vertical passage, where a post member can be inserted into the non-vertical passage and driven into the ground at an angle.

19 Claims, 21 Drawing Sheets

(56) References Cited

OTHER PUBLICATIONS

"Economy Round Style High Tunnel," Retrieved at <<http://www.farmtek.com/farm/supplies/prod1; ft1__greenhouses__accessories-ft1__hightunnels__1;pgpb01680r6c.html>>, Retrieved on Sep. 14, 2012, FarmTek, pp. 1-2.

"Rolling Thunder—Moveable Structure for Growing," Retrieved at <<http://www.rimolgreenhouses.com/greenhouse-series/rolling-thunder>>, Retrieved on Sep. 14, 2012, Rimol Greenhouses, pp. 1-2.

* cited by examiner

HOOP HOUSE ANCHORING SYSTEM AND KIT

RELATED APPLICATIONS

This application claims the benefit of U.S. Provisional Patent Application Ser. No. 61/535,503, filed Sep. 16, 2011, and entitled "HIGH TUNNEL HOOP ENCLOSURE", the entirety of which is incorporated herein by reference.

BACKGROUND

A hoop house is a tunnel with a flexible material applied around a series of hoops. The flexible material, for instance, can be made of polyethylene. Moreover, hoops included in conventional hoop houses oftentimes are semi-circular, square, or elongated. Hoop houses are commonly utilized as greenhouses; for instance, incoming solar radiation from the sun can heat an interior of the hoop house faster than heat can escape from the hoop house, which can warm plants, soil, etc. enclosed within the hoop house. Accordingly, a hoop house can be used as an off-season greenhouse, where the hoop house can retain heat during cool weather and protect crops from the environment (e.g., thereby extending a growing season). Moreover, a hoop house can provide higher humidity than that which is available in the environment. Further, a hoop house can protect crops from heat, bright sunlight, strong winds, hailstorms, cold waves, and other environmental conditions. Hoop houses can also be used for other purposes such as storage or shelter.

Hoop houses are typically secured to the ground with conventional anchor posts. A hoop house can be secured to the ground to mitigate displacement of the hoop house under various environmental conditions (e.g., wind, etc.), which otherwise may damage the hoop house or contents within the hoop house or cause a position of the hoop house to be altered. For instance, one end of an anchor post can be vertically driven into the ground. Moreover, an opposite end of the anchor post can include an opening into which an end of a hoop may be inserted, for example. According to another example, the hoop can be attached to the anchor post utilizing a tie or the like. By way of a further example, ends of each hoop can be driven down into the ground and act as anchors.

Installing anchor posts can be costly and labor intensive, as anchor posts oftentimes are accurately located and driven down several feet into hard or irregular surfaces such as concrete or rocky soil. An improperly located or insufficiently buried anchor post can compromise stability and safety of a hoop house.

SUMMARY

Described herein are various technologies that pertain to an anchoring system for a hoop house that includes a horizontal member. The horizontal member includes an anchor connector and a hoop connector. The anchoring system further comprises an anchor, where the anchor can include an attachment member and a post member. The attachment member can be disposed adjacent to the anchor attachment region of the horizontal member and can be restrained by a restraint passing through a hole in the attachment member and a hole in the anchor attachment region. The post member can be received in a diagonal passage in the attachment member and can be driven into a ground surface.

In some embodiments, the attachment member of the anchor can include a first clamp grip that includes the diagonal passage, and a second clamp grip that includes a disparate diagonal passage, where the first clamp grip and the second clamp grip can be opposable. The diagonal passage and the disparate diagonal passage can cross. Further, a second post member can be received in the disparate diagonal passage and can be driven into the ground surface.

Further, the hoop connector can be configured to connect an end of a hoop to the horizontal member. The hoop connector can include a vertical cavity. In various embodiments, the hoop connector can be a pair of opposing T-junction clamp shells that from a T-junction when disposed around the horizontal member and the end of the hoop. In some embodiments, multiple anchors and or multiple hoops may be affixed to the horizontal member. In some embodiments, the anchoring system comprises a disparate horizontal member. A horizontal member may be disposed along each side of a hoop house, and in some embodiments, horizontal members may be connected in series (e.g., via a horizontal member junction).

The anchor may be removed from the anchor connector, and a removable mobility support can be affixed to the hoop house when the hoop house is desired to be relocated. When the hoop house is in a desired location, the removable mobility support can be removed and the anchor can be reattached.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
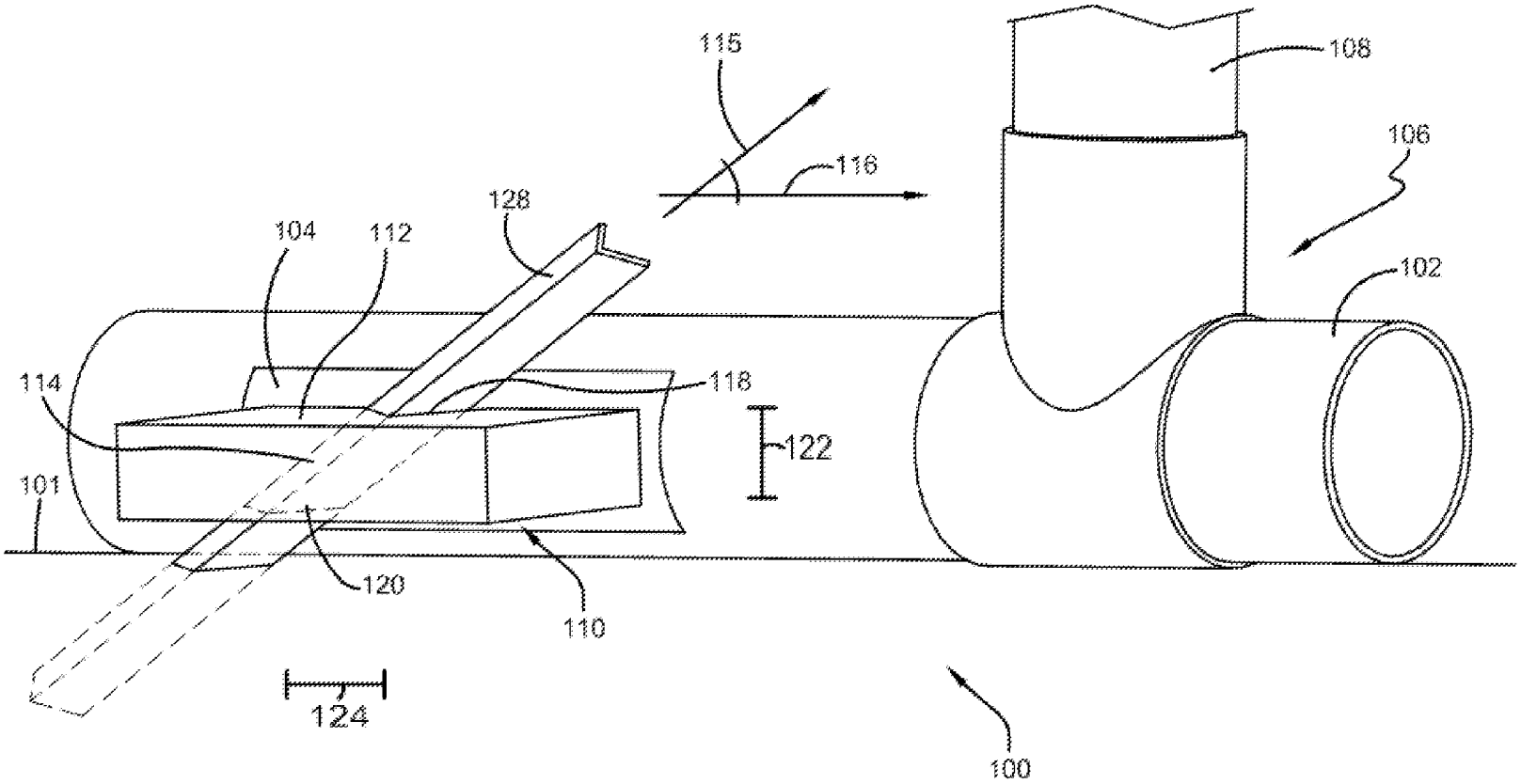
FIG. 1 illustrates a side view of an exemplary anchoring system for a hoop house.

Various technologies pertaining to hoop houses will now be described with reference to the drawings, where like reference numerals represent like elements throughout. In addition, several functional block diagrams of exemplary systems are illustrated and described herein for purposes of explanation; however, it is to be understood that functionality that is described as being carried out by certain system components may be performed by multiple components. Similarly, for instance, a component may be configured to perform functionality that is described as being carried out by multiple components. Additionally, as used herein, the term "exemplary" is intended to mean serving as an illustration or example of something, and is not intended to indicate a preference.

The term "hoop house" is utilized herein. A hoop house can also be referred to as a polytunnel, a polyhouse, a hoop greenhouse, a high tunnel, or the like.

With reference to FIG. 1, illustrated is a side view of an exemplary anchoring system 100 for a hoop house. The anchoring system 100 includes a horizontal member 102. In some embodiments, the horizontal member 102 can be a base frame for other elements of a hoop house. The horizontal member 102 can be positioned on a ground surface 101, for example; yet, although not shown, it is also contemplated that the horizontal member 102 alternatively may be positioned on and/or coupled to legs, supports, wheels, or other the like, which can be positioned on the ground surface 101.

The horizontal member 102 may be formed from a cylindrical pipe. Examples of material of the cylindrical pipe include, but are not limited to, steel, plastic (e.g., polyvinyl chloride (PVC), etc.), and so forth. It is contemplated that the cylindrical pipe can have substantially any diameter and length. By way of illustration, the horizontal member 102 may be formed from a cylindrical steel pipe (e.g., hollow or solid) with a two inch diameter and a length of 20 feet, 24 feet, or 40 feet; however, the claimed subject matter is not limited to the foregoing, and instead it is contemplated that other materials, diameters, and lengths are intended to fall within the scope of the hereto appended claims. Moreover, it is contemplated that the horizontal member 102 can be formed from substantially any other type of linear member made of a rigid material (e.g., wooden beam, etc.).

The horizontal member 102 includes an anchor connector 104 configured to mechanically connect (e.g., removably) with an anchor 110. The horizontal member 102 also includes a hoop connector 106 configured to mechanically connect with an end of a hoop 108; thus, the hoop 108 can be mechanically connected to the horizontal member 102. The hoop 108 is a non-linear support for a flexible roof of the hoop house. While FIG. 1 depicts the anchoring system 100 including one anchor connector (e.g., the anchor connector 104) and one hoop connector (e.g., the hoop connector 106), it is contemplated that the anchoring system 100 can include substantially any number of anchor connectors (e.g., similar to the anchor connector 104) and hoop connectors (e.g., similar to the hoop connector 106).

In some embodiments, the anchor connector 104 of the horizontal member 102 can include a one or more passages through the horizontal member 102. For example, in an embodiment where the horizontal member 102 is formed from a hollow pipe (e.g., hollow steel pipe, hollow PVC pipe, etc.), the anchor connector 104 can include a pair of holes through the hollow pipe that are aligned; thus, a first hole in the pair can be through a first side of the hollow pipe and a second hole in the pair can be through a second side of the hollow pipe, where the first hole and the second hole are aligned to form the passage through the horizontal member 102. The first hole and the second hole in the pair through the hollow pipe, for example, can be radially aligned (e.g., a radial passage can be formed through the horizontal member 102 by the pair of holes); yet, other alignments of the pair of holes through the hollow pipe are contemplated (e.g., the passage can be in a direction of a chord, etc.). Moreover, in an embodiment where the horizontal member 102 is formed from a solid pipe, the anchor connector 104 can include a hole through the solid pipe (e.g., radially oriented, oriented along a chord, etc.) to form the passage through the horizontal member 102. Further, it is contemplated that the anchor connector 104 can include a plurality of passages through the horizontal member 102 (e.g., a plurality of pairs of holes, a plurality of holes, etc.). In yet other embodiments, the anchor connector 104 can include a ring affixed to the horizontal member 102, a threaded passage through the horizontal member 102, a portion of an exterior surface of the horizontal member 102, or the like.

The anchor 110 includes an attachment member 112 that can be removably affixed to the anchor connector 104. The attachment member 112 defines a passage 114. When the attachment member 112 is connected with the anchor connector 104, the passage 114 forms an angle 115 with respect to a linear axis 116 of the horizontal member 102. The passage 114 includes a first end 118 and a second end 120. The second end 120 is set off from the first end 118 by a vertical offset 122 perpendicular to the linear axis 116 of the horizontal member 102 and by a horizontal offset 124 along the linear axis 116 of the horizontal member 102 in a first direction. In some embodiments, the angle 115 can be within a range between 30 degrees and 60 degrees (e.g., the angle 115 can be approximately 45 degrees, etc.); however, other angles may be similarly adopted.

The anchor 110 further includes a post member 128 receivable within the passage 114. When the attachment member 112 is affixed to the anchor connector 104, the post member 128 can be received in the passage 114 and driven into the ground surface 101 at the angle 115. Thus, the passage 114 guides the post member 128 at the angle 115 when the post member 128 is driven into the ground surface 101. With the post member 128 driven into the ground surface 101 at the angle 115, as opposed to the convention of vertically driven anchor posts, the anchor 110 may withstand greater shear stresses and strains acting on the hoop house.

In contrast to the configuration provided herein, traditional approaches oftentimes include posts vertically driven into the ground. However, rocks or other obstructions may impede the insertion of such posts, or bend such posts which can detrimentally impact use of the posts for anchoring a hoop house. Conversely, with the anchoring system 100, the post member 128 may be positioned to navigate around rocks or obstructions (e.g., varying the angle 115, repositioning the anchor 110 along the horizontal member 102, etc.). Additionally, as opposed to the traditional vertically driven post configurations where a hoop is commonly connected to the vertically driven post, the hoop 108 is connectable to the hoop connector 106 rather than the anchor 110 (e.g., the post member 128), thereby mitigating a detrimental impact associated with bending of the post member 128. Further, the anchor connector 104 can provide a location for the anchor 110 based upon positioning of the horizontal member 102 as opposed to traditional approaches where conventional anchors oftentimes are independently positioned, which may be time consuming.

The post member 128 can be extractable from the ground surface 101. For example, the angle 115 of the post member 128 can provide a gripping surface for extraction. Thus, the post member 128 may be removed manually, with pliers, with a horizontal lever bar, or with other tools.

Figure 2:
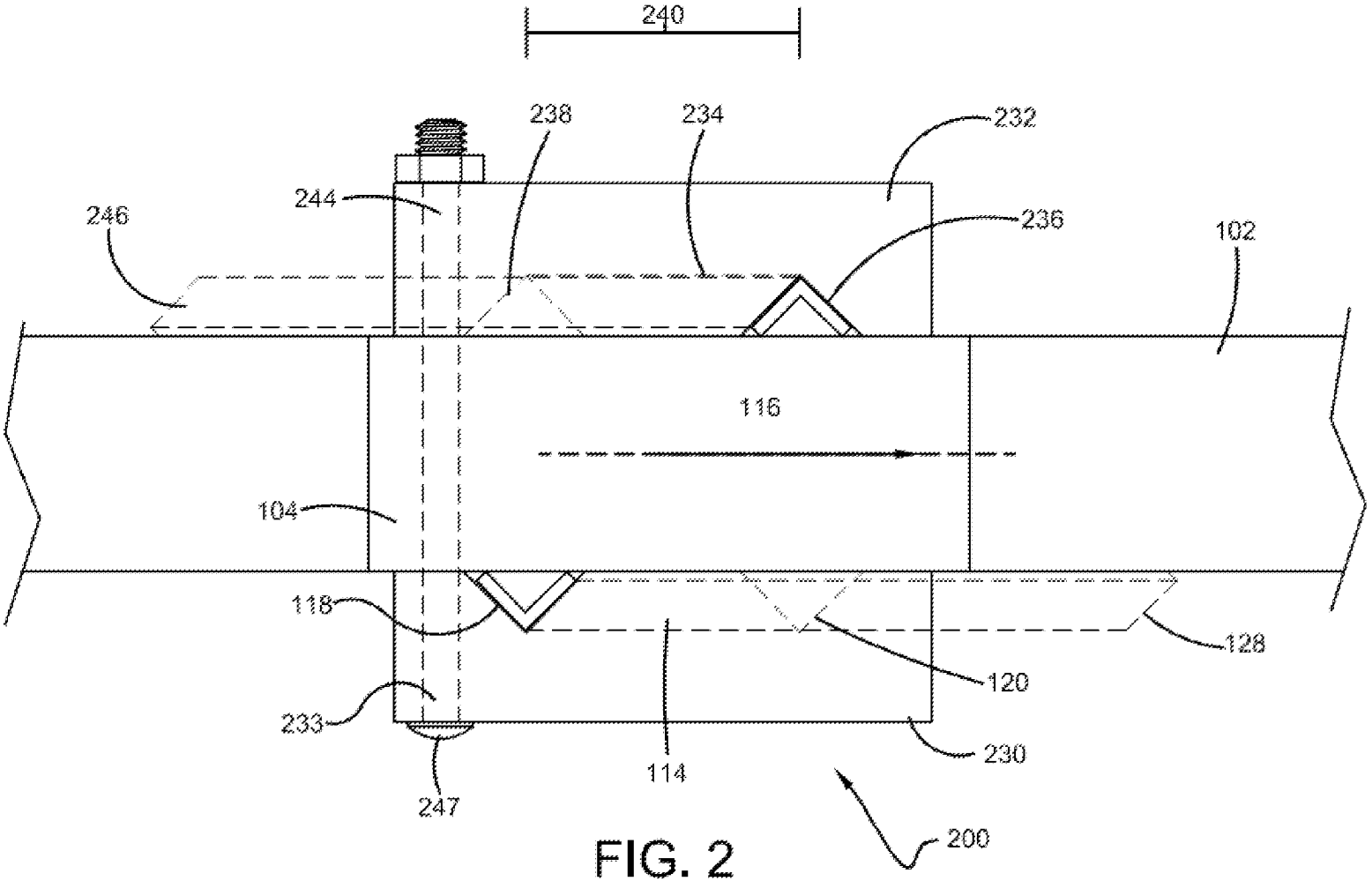
FIG. 2 illustrates a top view of an exemplary anchor of the anchoring system of FIG. 1.

Referring now to FIG. 2, illustrated is a top view of an exemplary anchor 200 of the anchoring system 100 of FIG. 1 (e.g., the anchor 200 can be the anchor 110 of FIG. 1). The anchor 200 includes an attachment member (e.g., the attachment member 112); more particularly, such attachment member of the anchor 200 includes a first clamp grip 230 and a second clamp grip 232, where the first clamp grip 230 and the second clamp grip 232 are opposable. The first clamp grip 230 and the second clamp grip 232 are removably attachable to the horizontal member 102 (e.g., the anchor connector 104).

The first clamp grip 230 comprises the passage 114. For example, in some embodiments, the first end 118 of the passage 114 and the second end 120 of the passage 114 can be notches in the first clamp grip 230, thus forming the passage 114 when the first clamp grip 230 is affixed to the horizontal member 102. In other embodiments, the passage 114 may be formed wherein the first end 118 and the second end 120 of the passage 114 are holes in the first clamp grip 230, wherein the clamp grip 230 comprises a grooved surface, or the like. The first clamp grip 230 further includes a first hole 233 through the first clamp grip 230.

The second clamp grip 232 includes a second passage 234. The second passage 234 includes a first end 236 and a second end 238. The second end 238 is set off from the first end 236 by a vertical offset (e.g., the vertical offset 122 depicted in FIG. 1, substantially similar to the vertical offset between the first end 118 and the second end 120, etc.) and by a horizontal offset 240 along the linear axis 116 of the horizontal member 102 in a second direction. The second direction of the horizontal offset 240 for the second passage 234 is opposite the first direction of the horizontal offset 124 for the passage 114. In some embodiments, the second passage 234 is at an angle of approximately equal magnitude as the angle 115 but horizontally flipped, although it is contemplated that the second passage 234 may be at a different angle than the angle 115 of the passage 114. The second clamp grip 232 also includes a second hole 244 through the second clamp grip 232. The first hole 233 through the first clamp grip 230 and the second hole 244 through the second clamp grip 232 can be aligned.

The anchor 200 as depicted in FIG. 2 further includes a second post member 246 receivable within the second passage 234 and driven into the ground surface 101. The second post member 246, being at an angle that is different than the angle 115 of the first post member 128, may enhance performance of the anchor 200.

The anchor 200 further comprises a restraint 247 extending through the first hole 233 of the first clamp grip 230, the anchor connector 104 of the horizontal member 102, and the second hole 244 of the second clamp grip 232. The restraint 247 affixes the first clamp grip 230 and second clamp grip 232 to the anchor connector 104 of the horizontal member 102. By way of example, the restraint 247 can be a threaded bolt, a bolt and nut, a rivet, a tie, or the like. For instance, the restraint 247 may comprise a bolt passing through the first hole 233, the anchor connector 104, and the second hole 244, and may also comprise a nut disposed on an end of the bolt to lock the bolt in place.

Figure 3:
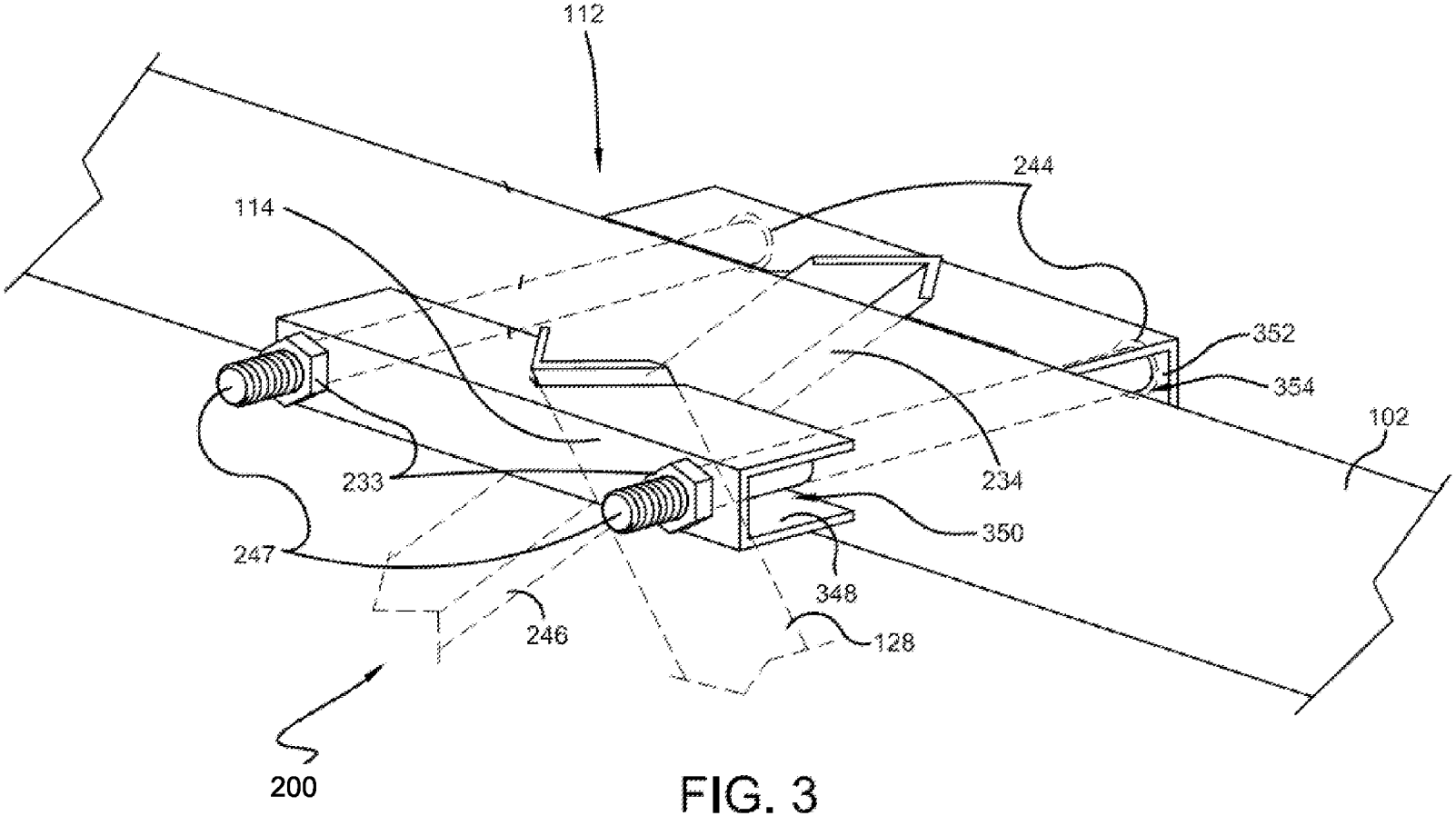
FIG. 3 illustrates an isometric view of the exemplary anchor of FIG. 2.

Referring now to FIG. 3, illustrated is an isometric view of the exemplary anchor 200 of FIG. 2. The anchor 200 includes the first clamp grip 230 and the second clamp grip 232. As depicted, the first clamp grip 230 and the second clamp grip are U-shaped braces, where respective opened ends of the U-shaped braces are positioned adjacent to the horizontal member 102.

In some embodiments, the first clamp grip 230 can include a first inner surface 348 and the second clamp grip 232 can include a second inner surface 352. The first inner surface 348 of the first clamp grip 230 defines a first concave cavity 350 of the first clamp grip 230, and the second inner surface 352 of the second clamp grip 232 defines a second concave cavity 354 of the second clamp grip 232. When the attachment member 112 is affixed to the horizontal member 102, the first concave cavity 350 and the second concave cavity 354 can further be defined by an exterior surface of the attachment member 112.

As depicted in FIG. 3, the first clamp grip 230 includes two holes 233 and the second clamp grip 232 includes two holes 244. Restraints 247 can each pass through a respective one of the holes 233 and a respective one of the holes 244 as illustrated.

In some embodiments, the first passage 114 and the second passage 234 can include a keyed cross-section. In such embodiments, the post member 128 and the post member 246 can be keyed to the keyed cross-section of the first passage 114 and the second passage 234, respectively. For example, when the first passage 114 and second passage 234 are formed by a pair of angled notches, the post member 128 and the post member 246 can have a triangular or v-like cross-section.

Figure 4:
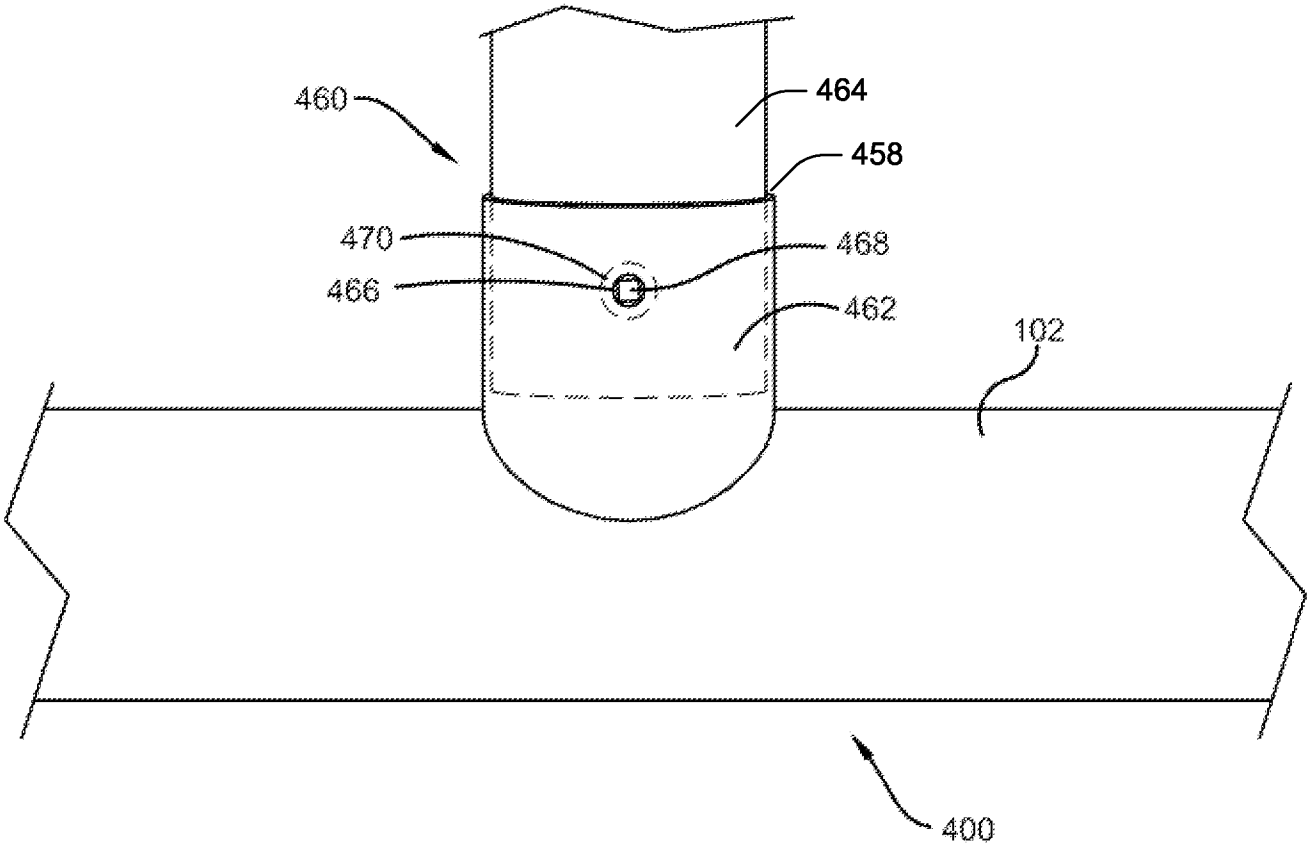
FIG. 4 illustrates a side view of an exemplary hoop connector of the anchoring system of FIG. 1.

Referring now to FIG. 4, illustrated is a side view of an exemplary hoop connector 400 of the anchoring system 100 of FIG. 1 (e.g., the hoop connector 400 can be the hoop connector 106 of FIG. 1). The hoop connector 400 includes a vertical cavity 460 with an opening at a top end 458 of the hoop connector 400. An end 462 of a hoop 464 (e.g., the hoop 108 of FIG. 1) can be receivable in the vertical cavity 460. It is contemplated that the hoop 464 can have substantially any shaped cross-section (e.g., circular, rectangular, triangular, etc.) and the vertical cavity 460 can have substantially any shaped cross-section (e.g., circular, rectangular, triangular, etc.). For instance, the shape of the cross-section of the hoop 464 can match the shape of the cross-section of the vertical cavity 460; yet, it is to be appreciated that such shapes of the cross-sections can differ.

According to various embodiments, the hoop connector 400 can include a hole 466 through a side of the hoop connector 400 (e.g., the hole 466 can be radially oriented, etc.). Although not shown, it is contemplated that the hoop connector 400 can further include an opposing hole through an opposite side of the hoop connector 400, where the opposing hole and the hole 466 are aligned. Moreover, the hoop 464 includes a hole 470 near the end 462 of the hoop 464. When the end 462 of the hoop 464 is received within the vertical cavity 460, the hole 466 through the side of the hoop connector 400 and the hole 470 through the hoop 464 (and the opposing hole through the opposite side of the hoop connector 400) can be aligned, and a hoop restraint 468 can be receivable there through. For example, the hoop restraint 468 can be a threaded bolt, a bolt and nut, a tie, a pin, or the like.

In some embodiments, the hoop connector 400 and the horizontal member 102 can be contiguously formed (e.g., formed from a common mold, formed from a common piece of material, etc.). In other embodiments, the hoop connector 400 and the horizontal member 102 can be separately formed and thereafter joined (e.g., welded together, etc.). In yet other embodiments, the hoop connector 400 can be an indentation or hole in the horizontal member 102 (e.g., the vertical cavity 460 can be within the horizontal member 102) such that the hoop 464 can be receivable within the horizontal member 102.

Figure 5:
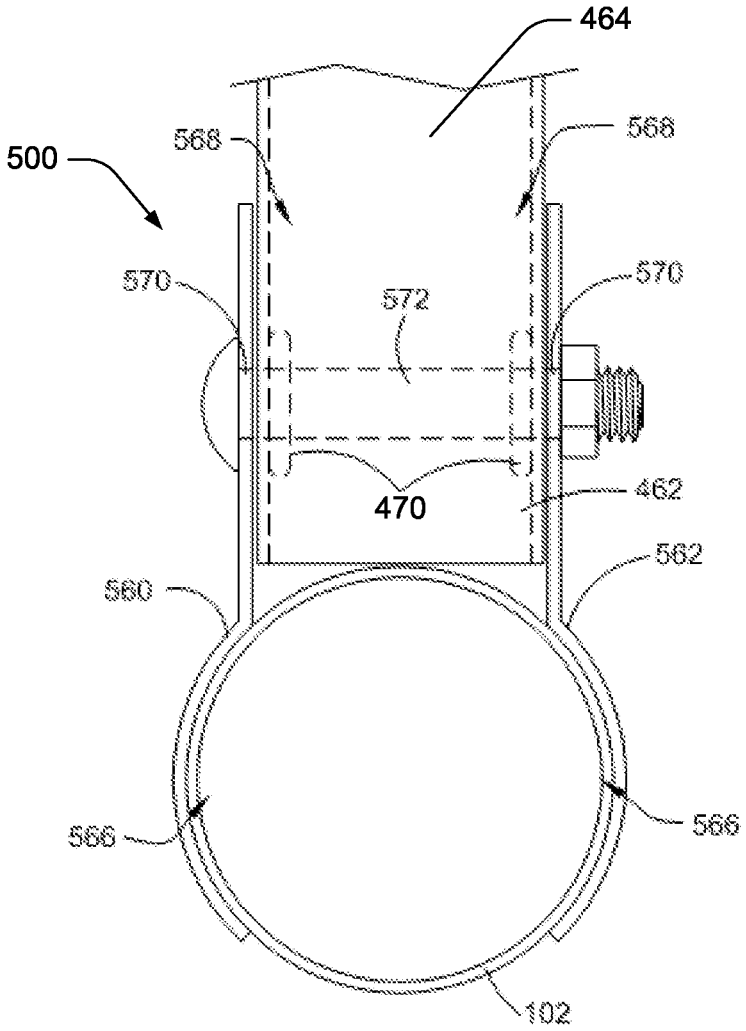
FIG. 5 illustrates a front cross-sectional view of another exemplary hoop connector for the anchoring system of FIG. 1.

With reference to FIG. 5, illustrated is a front cross-sectional view of another exemplary hoop connector 500 for the anchoring system of FIG. 1 (e.g., the hoop connector 500 can be the hoop connector 106 of FIG. 1). The hoop connector 500 includes a first T-junction clamp shell 560 and a second T-junction clamp shell 562. The first T-junction clamp shell 560 and the second T-junction clamp shell 562 are opposable.

The first T-junction clamp shell 560 and second T-junction clamp shell 562 each include a respective inner surface that comprises a first region 566 that defines a horizontal cavity and a second region 568 that defines a vertical cavity. The first region 566 and the second region 568 of the inner surface can be contiguous for the first T-junction clamp shell 560 and the second T-junction clamp shell 562. Further, the horizontal member 102 is receivable in the respective horizontal cavities (e.g., surrounded by the first region 566 of the inner surface of the first T-junction clamp shell 560 and the second T-junction clamp shell 562) and the end 462 of the hoop 464 is receivable in the respective vertical cavities (e.g., surrounded by the second region 568 of the inner surface of the first T-junction clamp shell 560 and the second T-junction clamp shell 562). The first T-junction clamp shell 560 and the second T-junction clamp shell 562 form a T-junction around the horizontal member 102 and the end 462 of the hoop 464 when the horizontal member 102 is disposed in the respective horizontal cavities and when the end 462 of the hoop 464 is disposed in the respective vertical cavities.

Moreover, the first T-junction clamp shell 560 and the second T-junction clamp shell 562 can each include a respective hole 570 there through, where the holes 570 pass through the second region 568 of the inner surface of the first T-junction clamp shell 560 and the second T-junction clamp shell 562. The hoop connector 500 further includes a hoop restraint 572 that restrains the hoop 464 when the hoop restraint 572 is positioned through the respective holes 570 and the hole 470 near the end 462 of the hoop 464. The restraint 572 can be, for example, a threaded bolt, a bolt and nut, a tie, a pin, or the like.

Figure 6:
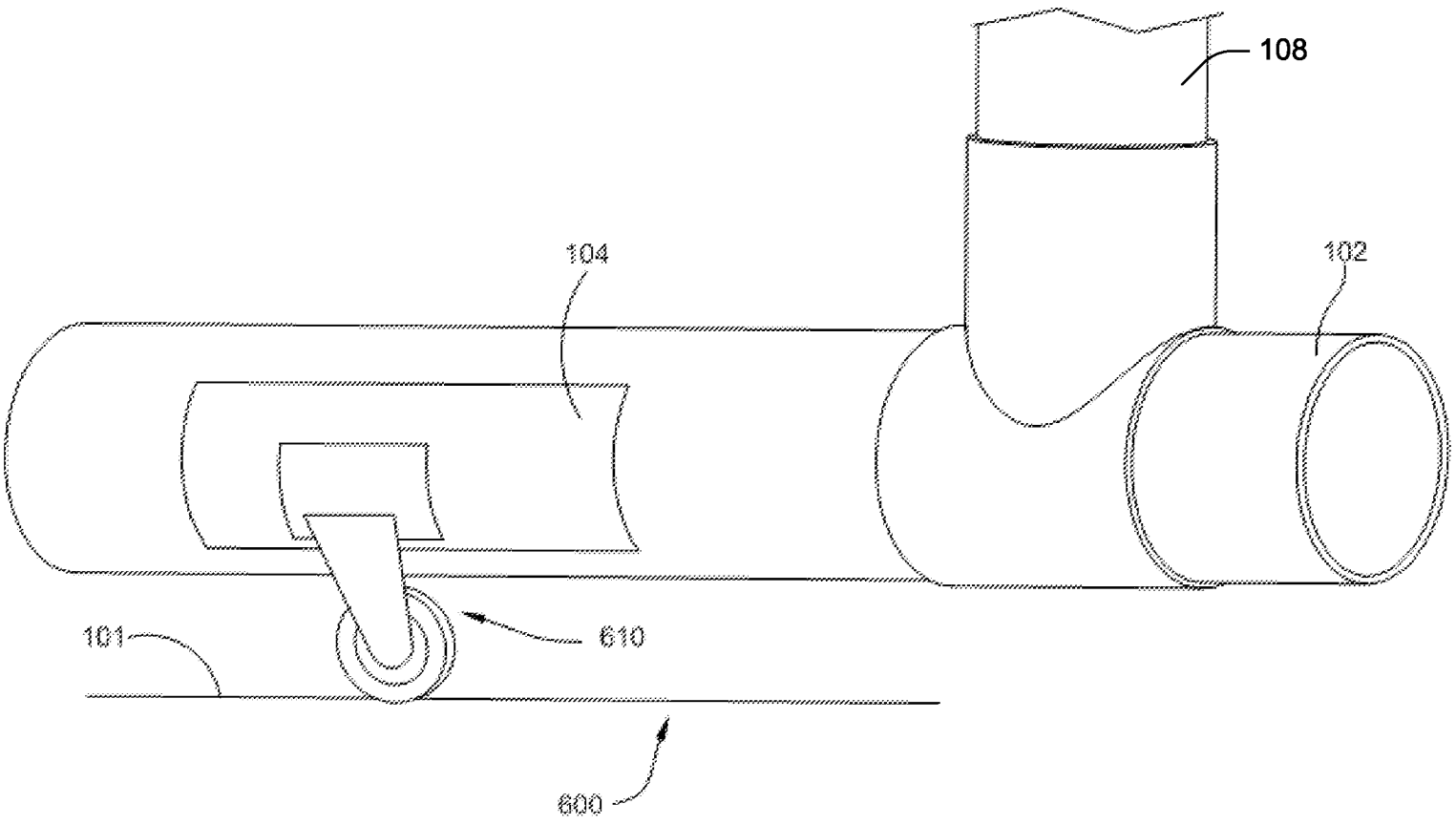
FIG. 6 illustrates a side view of another exemplary anchoring system for a hoop house that includes a removable mobility support.

Referring now to FIG. 6, illustrated is a side view of another exemplary anchoring system 600 for a hoop house. The anchoring system 600 includes a removable mobility support 610 affixed to the horizontal member 102. As shown in the example depicted in FIG. 6, the removable mobility support 610 can include a wheel affixed to the anchor connector 104 of the horizontal member 102. However, in other embodiments, the removable mobility support 610 can be affixed to a disparate region of the horizontal member 102, the hoop 108, an attachment member of an anchor (e.g., the attachment member 112 of the anchor 110 of FIG. 1), or the like. Pursuant to other examples, the removable mobility support 610 can include a ski, a trolley, a trailer, a cart, a truck bed, a combination thereof, etc. (e.g., in addition to or instead of the wheel as depicted in FIG. 6).

When the removable mobility support 610 is affixed to the horizontal member 102, and when the horizontal member 102 is unanchored, a hoop house can be mobile. According to an example, when mobile, the hoop house can be translated and/or rotated on the ground surface 101. Conventionally, a hoop house is disposed at a location at which it is constructed; oftentimes, such conventional hoop house typically is unable to be moved or difficult to move (e.g., via disassembly, etc.) at a later time. In contrast, by removing anchors from the hoop house (e.g., removing the attachment member 112 of FIG. 1 from the anchor connector 104 of the horizontal member 102) and attaching the removable mobility support 610 to the anchor connector 104, the hoop house may be moved to a new location (e.g., without being disassembled). Subsequent to moving the hoop house to the new location, the removable mobility support 610 may be removed, and the anchor(s) can be reattached to the anchor connector 104.

Although not shown, it is contemplated that in some embodiments a spacer can be utilized between the horizontal member 102 and a disparate horizontal member in conjunction with the removable mobility support 610 (e.g., the spacer can maintain a width between the horizontal member 102 and the disparate horizontal member). Accordingly, a first end of the spacer can be removably affixed to the horizontal member 102 and a second end of the spacer can be removably affixed to the disparate horizontal member. When mechanically connected to the horizontal member 102 and the disparate horizontal member, the spacer can help maintain a shape of the hoop house while being relocated.

Figure 7:
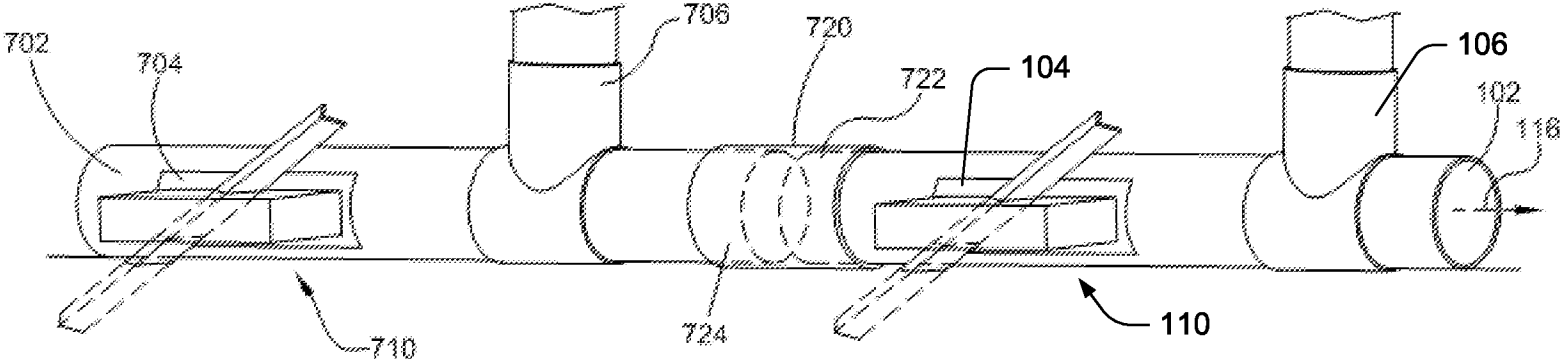
FIG. 7 illustrates a side view of yet another exemplary anchoring system for a hoop house.

Turning to FIG. 7, illustrated is a side view of yet another anchoring system 700 for a hoop house. The anchoring system 700 includes the horizontal member 102 and a disparate horizontal member 702. The disparate horizontal member 702 can be co-axial with the linear axis 116 of the horizontal member 102. Disposing the disparate horizontal member 702 in line with the horizontal member 102 can enable extending the hoop house, providing spacing between elements of the hoop house, and so forth.

As set forth above, the horizontal member 102 includes the anchor connector 104 and the hoop connector 106, where the anchor 110 can be removably affixed to the anchor connector 104. Similarly, the disparate horizontal member 702 includes a disparate anchor connector 704 and a disparate hoop connector 706. A disparate anchor 710 can be removably affixed to the disparate anchor connector 704. Although not shown, it is contemplated that the horizontal member 102 and the disparate horizontal member 702 can each respectively include substantially any number of anchor connectors and hoop connectors, and substantially any number of anchors can be removably affixed to such anchor connectors.

The anchoring system 700 further includes a horizontal member junction 720. A first end of the horizontal member junction 720 defines a first junction cavity 722 and a second end of the horizontal member junction 720 defines a second junction cavity 724. According to an example, the first junction cavity 722 and the second junction cavity 724 can be contiguous. By way of another example, the first junction cavity 722 and the second junction cavity 724 can be separate. As depicted in the example of FIG. 7, the horizontal member 102 can be received within the first junction cavity 722, and the disparate horizontal member 702 can be received within the second junction cavity 724.

Although not shown, it is to be appreciated that a plurality of horizontal member junctions 720 and a plurality of disparate horizontal members 702 can be connected in series with the horizontal member 102.

According to an example, the horizontal member junction 720 can further include a junction anchor connector and/or a junction hoop connector. The junction anchor connector can be substantially similar to the anchor connector 104 of the horizontal member 102 (e.g., an anchor can be removably affixed to the junction anchor connector). Moreover, the junction hoop connector can be substantially similar to the hoop connector 106 of the horizontal member 102 (e.g., a hoop can be coupled with the junction hoop connector).

While FIG. 7 depicts the horizontal member junction 720 defining the first junction cavity 722 and the second junction cavity 724, where the horizontal member 102 can be received in the first junction cavity 722 and the disparate horizontal member 702 can be received in the second junction cavity 724, it is contemplated that the horizontal member junction 720 can alternatively be received within the horizontal member 102 and/or the disparate horizontal member 702. For instance, the horizontal member 102 and the disparate horizontal member 702 can be hollow pipes, and the horizontal junction member 720 can be a tube insert which can be slid into such hollow pipes. Thus, it is to be appreciated that the horizontal member junction 720 can be an insert or a sleeve.

Figure 8:
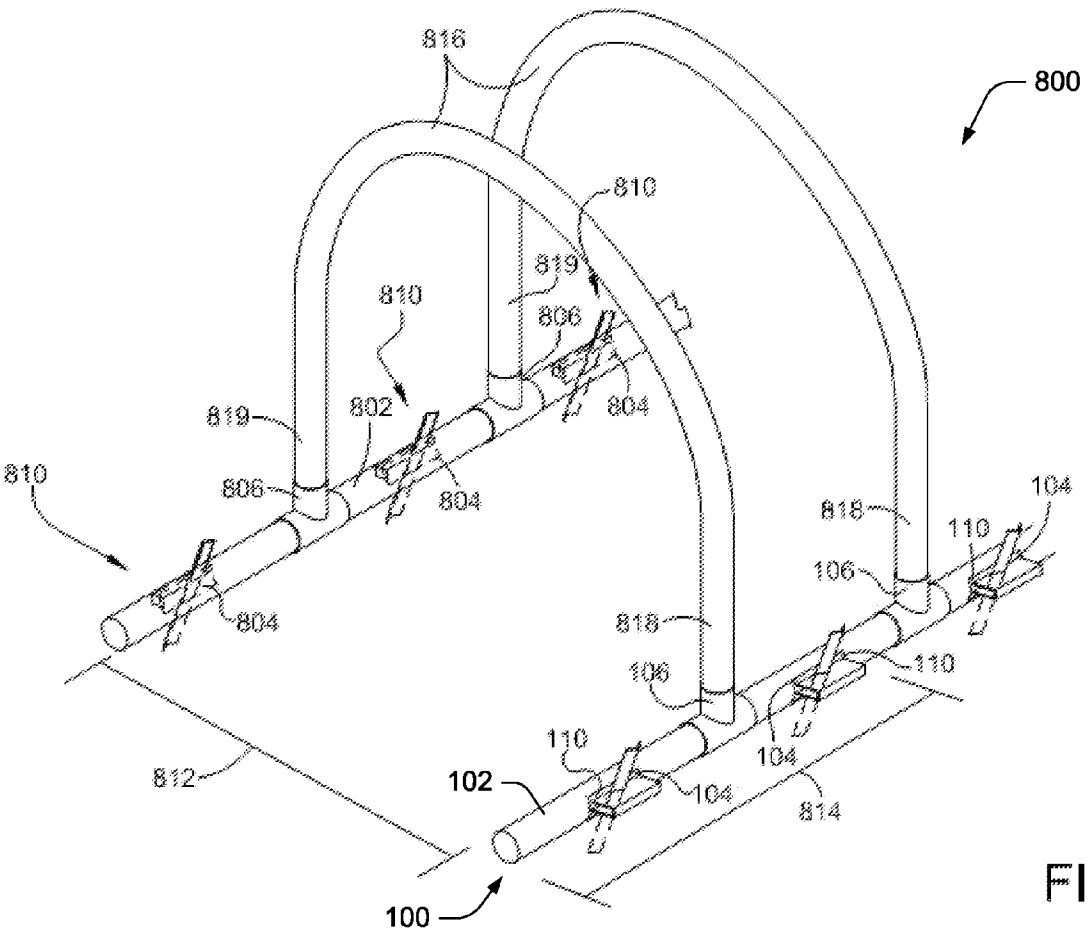
FIG. 8 illustrates an isometric view of an exemplary hoop house that includes the anchoring system of FIG. 1.

Referring now to FIG. 8, an isometric view of an exemplary hoop house 800 is illustrated. The hoop house 800 includes the anchoring system 100. More particularly, the hoop house 800 includes the horizontal member 102 described herein. As illustrated in FIG. 8, the horizontal member 102 includes three anchor connectors 104 and two hoop connectors 106. Three anchors 110 are removably affixed to the three anchor connectors 104 in the depicted example.

Further, the hoop house 800 includes a disparate horizontal member 802. In the depicted example, the disparate horizontal member 802 includes three disparate anchor connectors 804 and two disparate hoop connectors 806. Three disparate anchors 810 are removably affixed to the three disparate anchor connectors 804.

Moreover, the hoop house 800 can include a plurality of hoops 816. Respective first ends 818 of the hoops 816 can be connected to the horizontal member 102 via the respective hoop connectors 106. Further, respective second ends 819 of the hoops 816 can be connected to the disparate horizontal member 802 via the respective disparate hoop connectors 806.

It is contemplated that the hoop house 800 can have various dimensions. For instance, a distance 812 between the horizontal member 102 and the disparate horizontal member 802, also referred to as a width of the hoop house 800, can be, for example, 10 feet, 12 feet, 15 feet, or the like. Moreover, the hoop house 800 can have various ratios between a length 814 of the horizontal member 102 and the disparate horizontal member 802 and the width 812. Examples of such ratios between the length 814 and the width 812 can be in a range from about 1:1 to about 4:1 or greater (e.g., the ratio can be 3.5:1, etc.). This ratio may have an effect on air regulation in the tunnel interior. For example, a ratio of 3.5:1 may decrease dead air pockets in the interior of the hoop house 800, and thus, facilitate temperature regulation.

Figure 9:
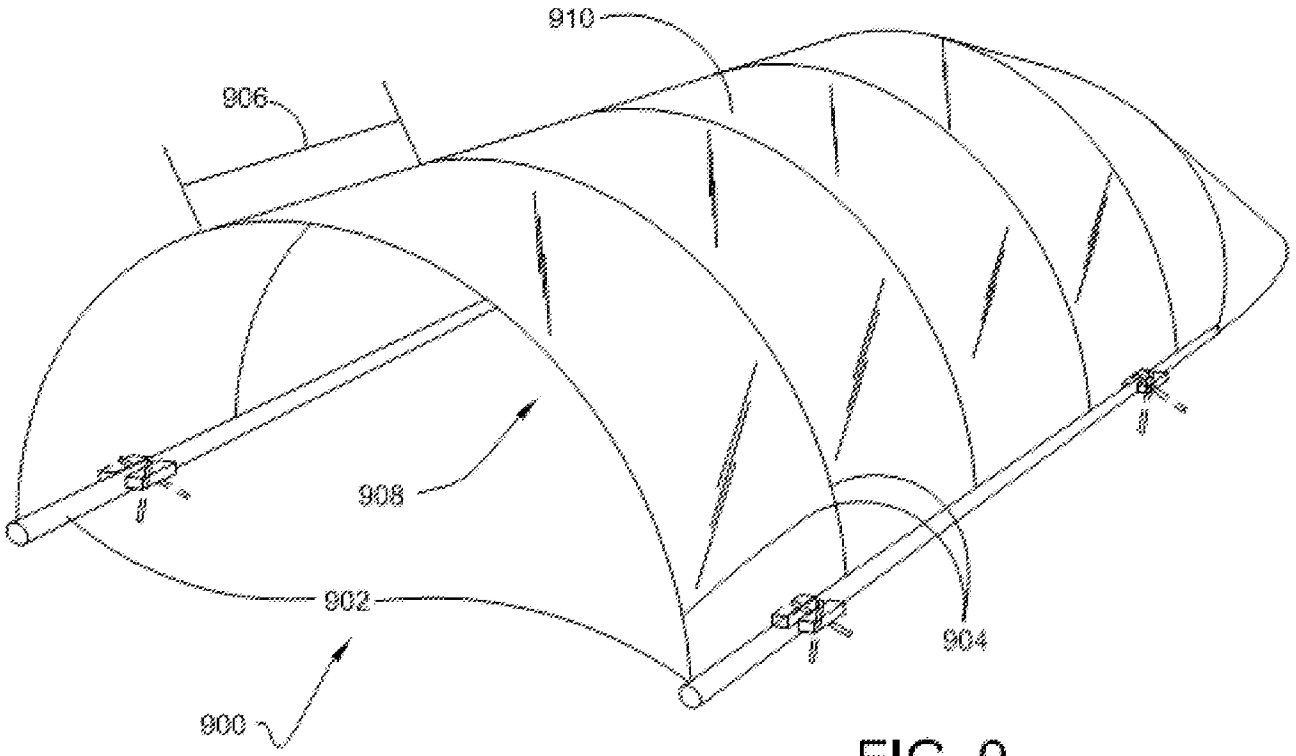
FIG. 9 illustrates an isometric view of an exemplary hoop house.

Now turning to FIG. 9, illustrated is an isometric view of an exemplary hoop house 900 that includes an anchoring system 902. The hoop house 900 further comprises a plurality of hoops 904 connected to the anchoring system 902. The plurality of hoops 904 can be separated by a distance 906 (e.g., the distance 906 can be approximately 4 feet between each of the hoops 904, greater than 4 feet, less than 4 feet). Moreover, it is contemplated that hoops 904 can be separate by differing distances (e.g., a first hoop and second hoop can be separated by a distance of X feet, and the second hoop and a third hoop can be separated by a distance of Y feet, where X and Y differ). The plurality of hoops 904 may be curved members, such as, for example, bent steel pipe. According to an illustration, the hoops 904 can be formed from 1⅜" 16 gage structural steel pipe, although it should be understood that other materials, sizes and shapes may be similarly adopted. The plurality of hoops 904 may be similarly sized, or may be of varied sizes. The plurality of hoops 904 defines an interior 908 of the hoop house 900.

The hoop house 900 further includes a flexible roof 910 disposed about the plurality of hoops 904. The flexible roof 910 can be secured to horizontal members using connectors such as ties, staples, fasteners, wire, channel, or the like. The flexible roof 910 can be formed from a material selected to provide protection from wind, rain, sunlight, ultra-violet light, condensation, or other factors. According to an example, the flexible roof 910 can be a 6 mm thick single-layer thermal AC poly film; yet, the claimed subject matter is not limited to the foregoing example.

In some embodiments, the flexible roof 910 can additionally include a power generator such as, for example, a solar panel, a wind turbine, or the like. Moreover, while not depicted, it is contemplated that the hoop house 900 can include a floor. Such floor can be made of a removable material such as, for example, sod, bricks, a tarp, fabric, wood planks or the like, or other materials such as gravel, concrete, packed dirt, stone, tile, or the like. Further, in some embodiments, the hoop house 900 may additionally include base boards disposed along horizontal members of the hoop house.

Figure 10:
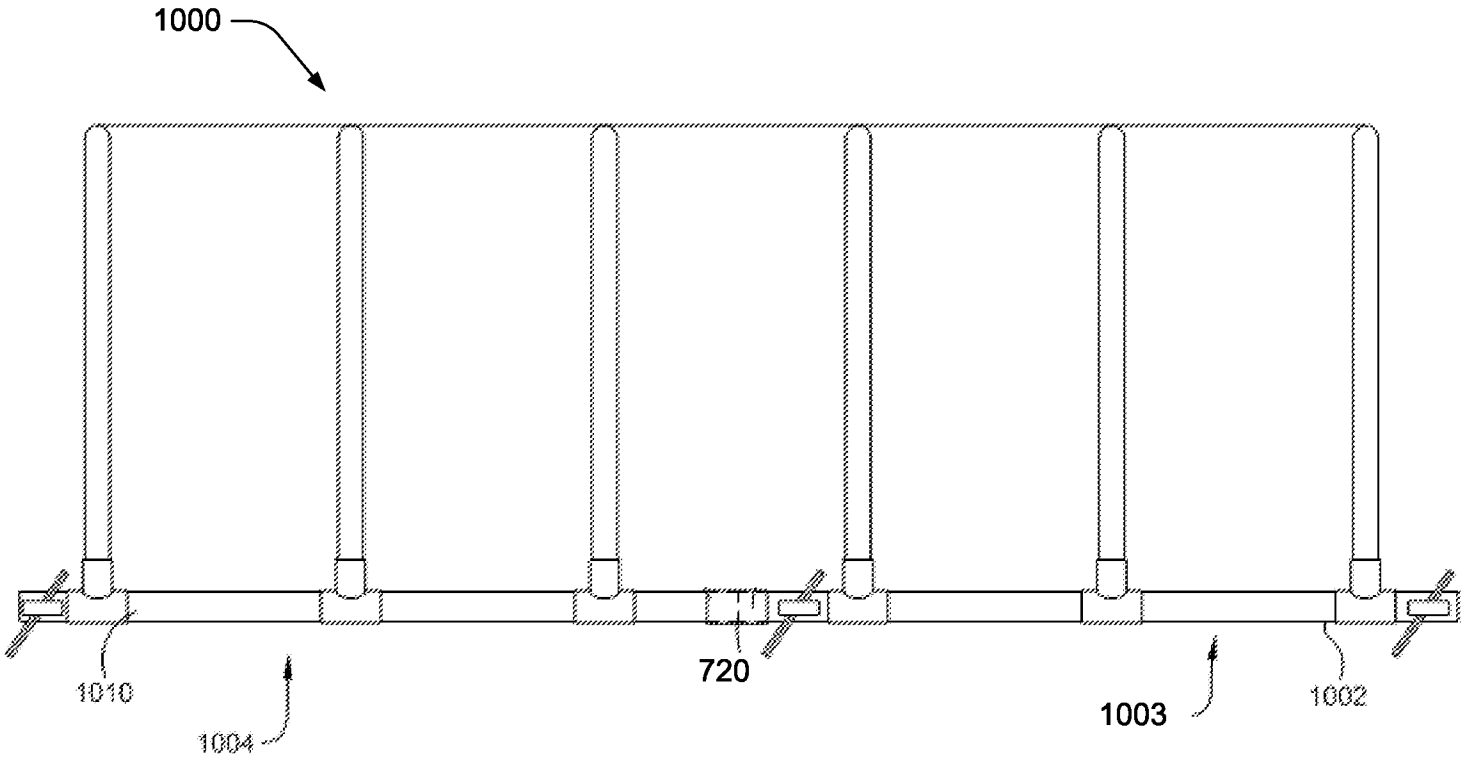
FIG. 10 illustrates a side cross-sectional view of another exemplary hoop house that includes an anchoring system.

Referring now to FIG. 10, a cross-sectional view of another exemplary hoop house 1000 comprising an anchoring system 1002 is illustrated. The hoop house 1000 includes a first hoop house section 1003 and a second hoop house section 1004 (e.g., the first hoop house section 1003 can include the horizontal member 102 and the second hoop house section 1004 can include the disparate horizontal member 702 of FIG. 7). The first hoop house section 1003 and the second hoop house section 1004 are connected via the horizontal member junction 720 described above in connection with FIG. 7. It is contemplated that substantially any number of additional hoop house sections can be connected in series with the first hoop house section 1003 and the second hoop house section 1004.

Figure 11:
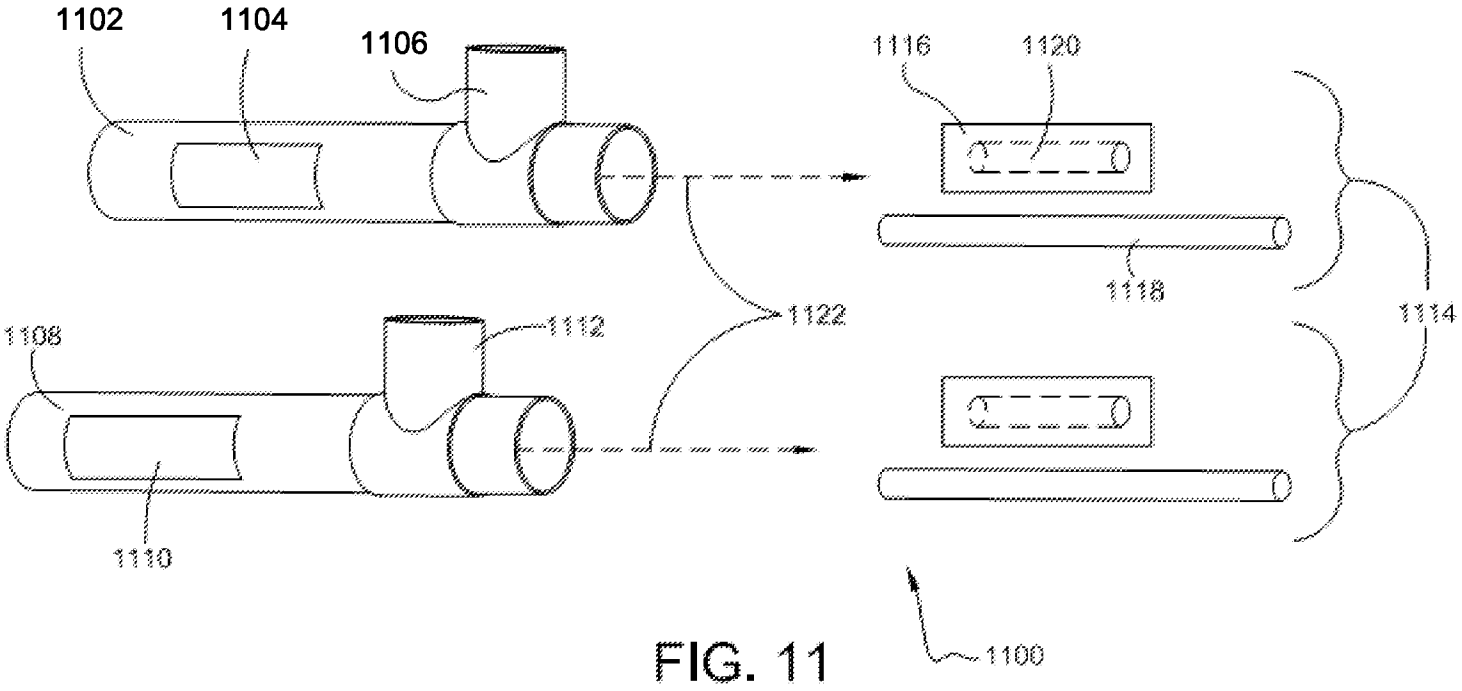
FIG. 11 illustrates an exemplary hoop house anchor kit.

With reference to FIG. 11, illustrated is an exemplary hoop house anchor kit 1100. The hoop house anchor kit 1100 includes a horizontal member 1102 that includes an anchor connector 1104 and a hoop connector 1106. The hoop house anchor kit 1100 further includes a disparate horizontal member 1108 that includes a disparate anchor connector 1110 and a disparate hoop connector 1112. The horizontal member 1102 and the disparate horizontal member 1008 can each be substantially similar to the horizontal member 102 of FIG. 1.

The hoop house anchor kit 1100 further includes a plurality of anchors 1114. Each anchor 1114 respectively includes an attachment member 1116 and a post member 1118. The attachment member 1116 comprises a non-vertical passage 1120. For instance, when the attachment member 1116 is affixed to an anchor connector of the horizontal member 1102 or the disparate horizontal member 1108, the non-vertical passage 1120 is neither perpendicular nor parallel to a linear axis 1122 of the horizontal member 1102 or the disparate horizontal member 1108. The post member 1118 is receivable in the diagonal passage 1120.

According to an example, the hoop house anchor kit 1100 may additionally include a removable mobility support affixable to an anchor connector, such as a wheel, ski, or the like. By way of another example, the hoop house anchor kit 1100 can also include one or more hoops. Pursuant to yet another example, the hoop house anchor kit 1100 can additionally include one or more horizontal member junctions. The hoop house anchor kit 1100 can further include other elements described herein.

Figure 12:
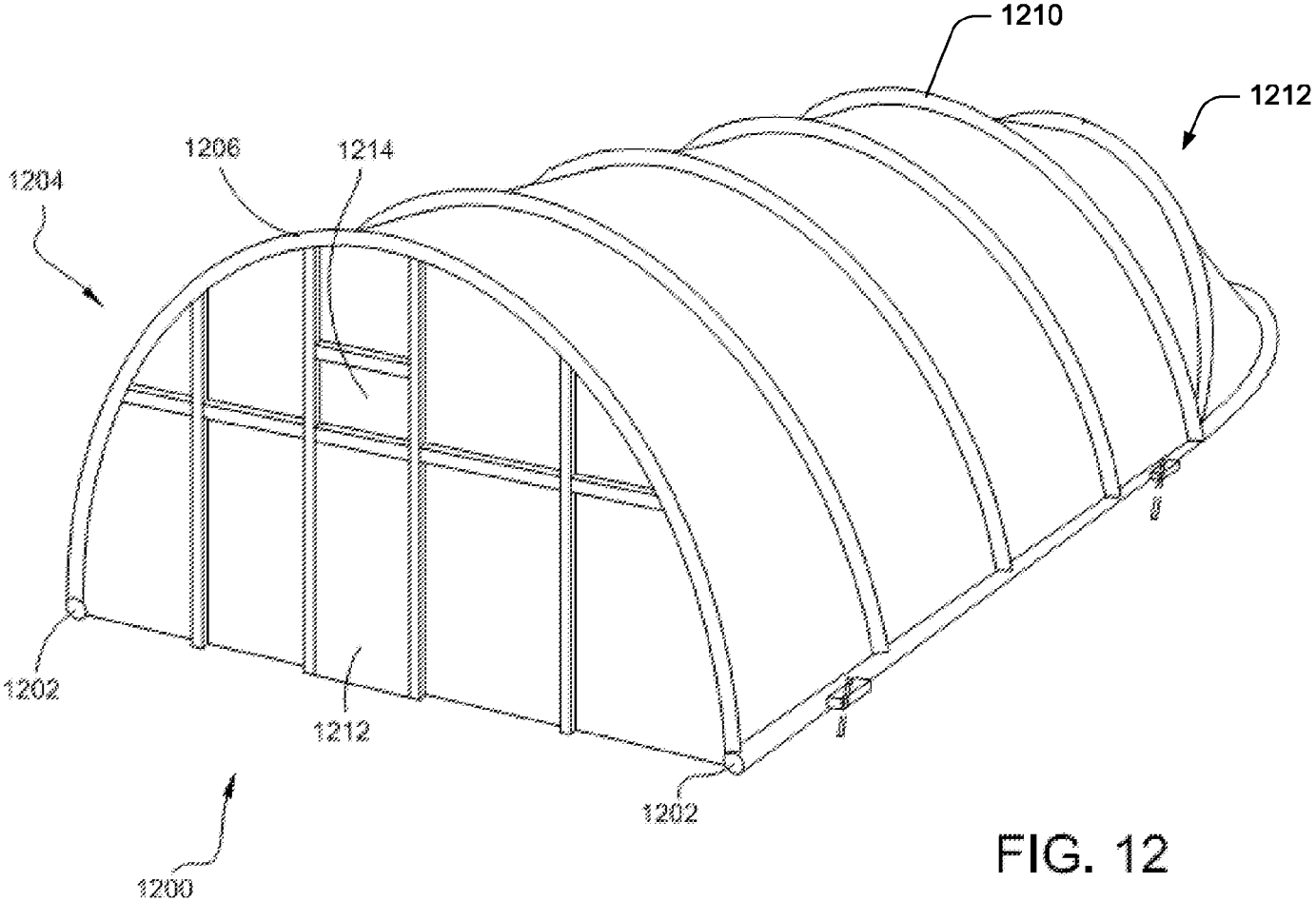
FIG. 12 illustrates an isometric view of an exemplary hoop house that includes an anchoring system and an end wall.

Referring now to FIG. 12, an isometric view of an exemplary hoop house 1200 that includes an anchor system 1202 and an end wall 1204 is illustrated. The end wall 1204 is disposed inside an end hoop 1206. In some embodiments, the end wall 1204 is removably secured to the end hoop 1206 by, for example, brackets and/or bolts. In some embodiments, the hoop house 1200 further includes a second end wall opposite the end wall 1204 and disposed inside a second end hoop 1210. In other embodiments (as depicted in FIG. 12), the hoop house 1200 further includes a retractable ventilation dome 1212 opposite the end wall 1204 and disposed inside the second end hoop 1210.

The end wall 1204 can include panels. According to an example, the panels can be wood panels (e.g., weatherized wood). Yet, it is contemplated that panels formed from substantially any other type of material is intended to fall within the scope of the hereto appended claims.

Moreover, the end wall 1204 can include a door 1212. However, in other embodiments, the end wall 1204 can include a doorway without the door 1212. The end wall 1204 can further include a vent 1214. The vent 1214 can provide ventilation or temperature regulation for the hoop house 1200 while maintaining protection from weather or the environment.

Figure 13:
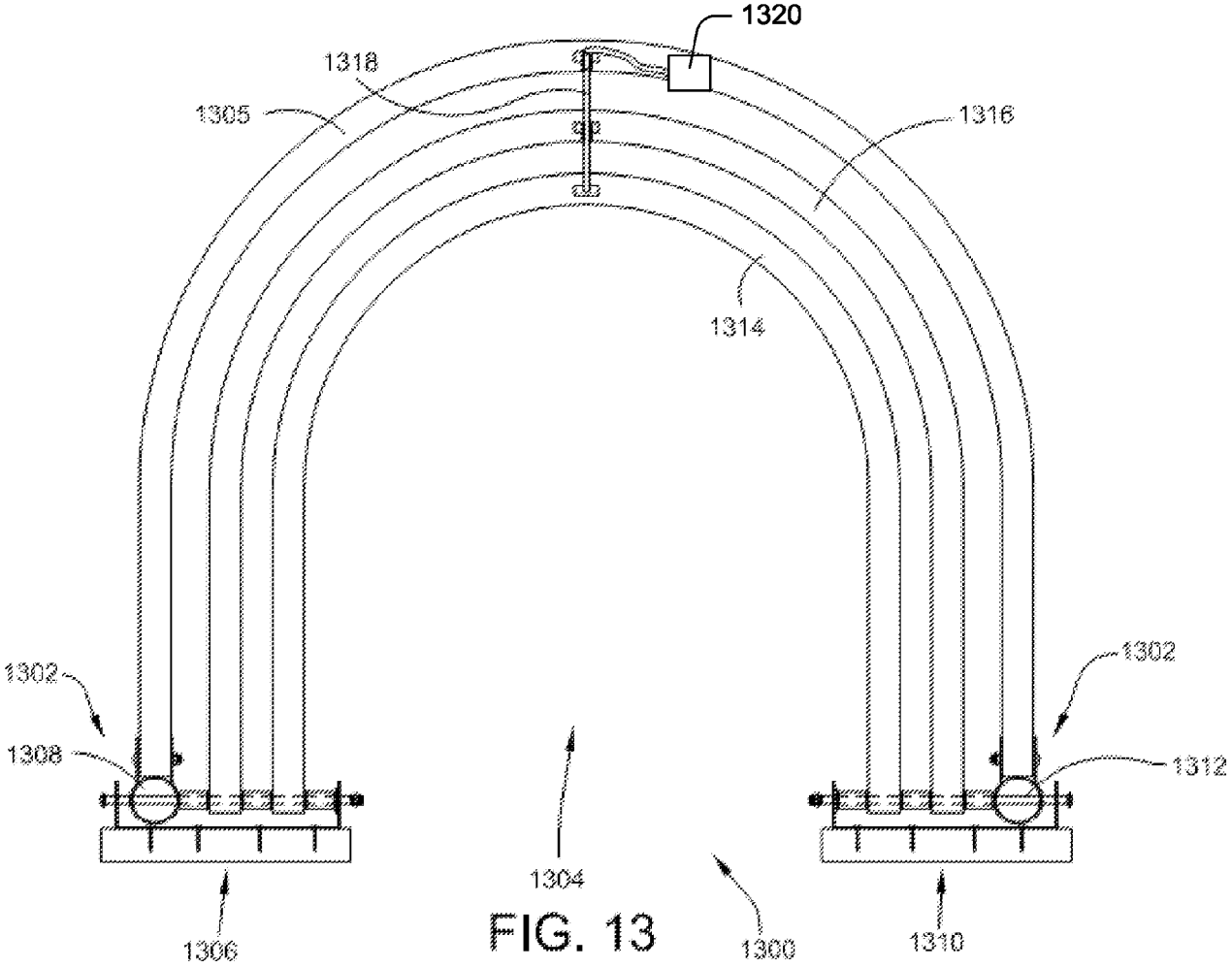
FIG. 13 illustrates a front view of an exemplary hoop house that includes a retractable ventilation dome in a retracted position.

Referring now to FIG. 13, a front view of an exemplary hoop house 1300 that includes an anchor system 1302 and a retractable ventilation dome 1304 (e.g., the retractable ventilation dome 1212 of FIG. 12) is illustrated. The retractable ventilation dome 1304 is depicted in a retracted position in FIG. 13.

The retractable ventilation dome 1304 is disposed adjacent with an end hoop 1305 and includes a first dome hinge 1306 connected to a horizontal member 1308 and a second dome hinge 1310 connected to a disparate horizontal member 1312. A base hoop 1314 is rotatably engaged with the first dome hinge 1306 and the second dome hinge 1310, and the base hoop 1314 is concentric to the end hoop 1305. A center hoop 1316 is rotatably engaged with the first dome hinge 1306 and the second dome hinge 1310, and the center hoop 1316 is concentric to the end hoop 1305 and the base hoop 1314.

A retraction member 1318 is affixed to the base hoop 1314, the center hoop 1316, and a retractor 1320. The retraction member 1318 can be a cable, rope, chain, or the like, and the retractor 1320 can be a crank, spool, motorized opener, or the like.

Figure 14:
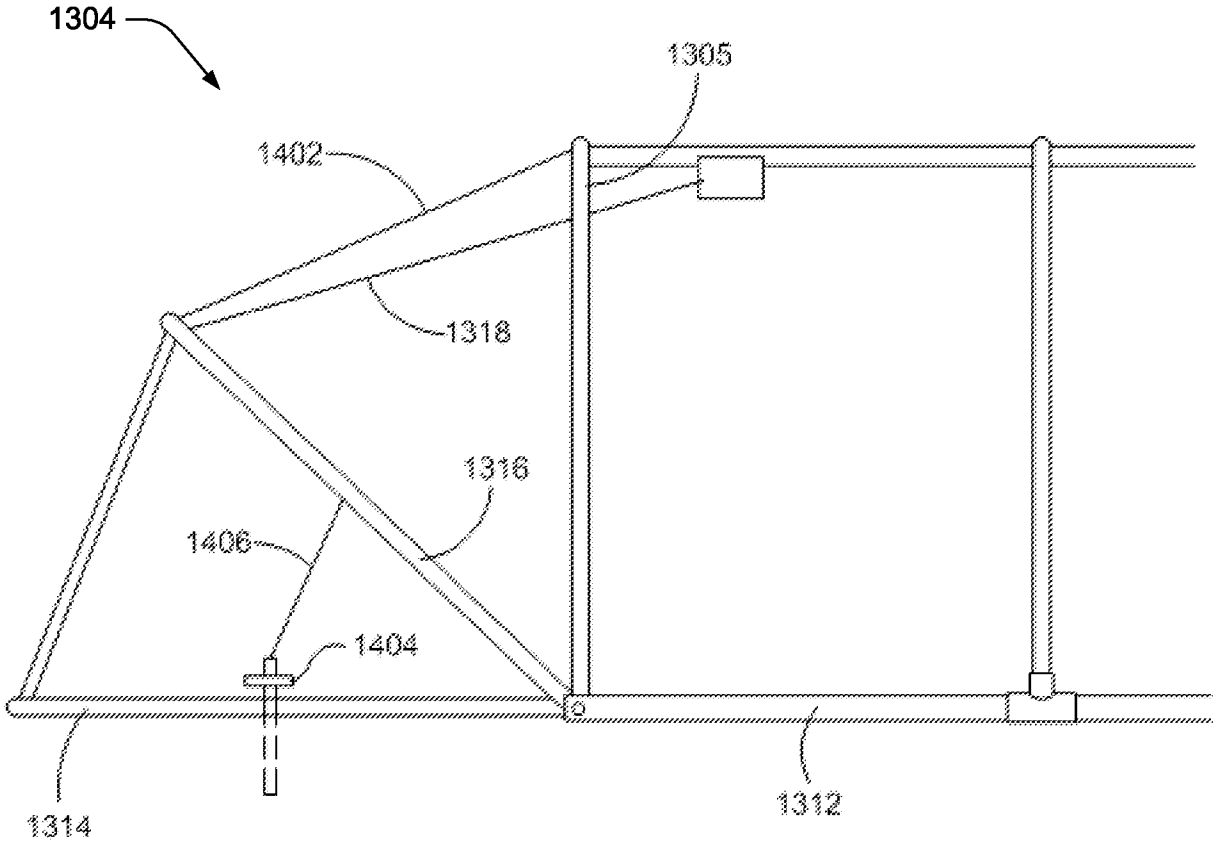
FIG. 14 illustrates a side cross-sectional view of the exemplary retractable ventilation dome of the hoop house of FIG. 13.

With reference to FIG. 14, illustrated is a side cross-sectional view of the retractable ventilation dome 1304 of the hoop house 1300 of FIG. 13. The retractable ventilation dome 1304 is illustrated in an extended position in FIG. 14.

The retraction member 1318 restrains the center hoop 1316 such that the center hoop is rotated between the end hoop 1305 and the base hoop 1314. A flexible material is affixed to the base hoop 1314, the center hoop 1316, and the end hoop 1305, defining a domed surface 1402.

In some embodiments, the retractable ventilation dome 1304 further includes a dome anchor 1404 affixed to the center hoop 1316. As shown in FIG. 14, the dome anchor 1404 can be connected to the center hoop 1316 via a cable 1406 such that the retractable ventilation dome 1304 can be retracted or extended while being connected to the dome anchor 1404. In other embodiments, the dome anchor 1404 can be removably affixed to the center hoop 1316 such that when the retractable ventilation dome 1304 is desired to be retracted, the dome anchor 1404 may be removed.

Figure 15:
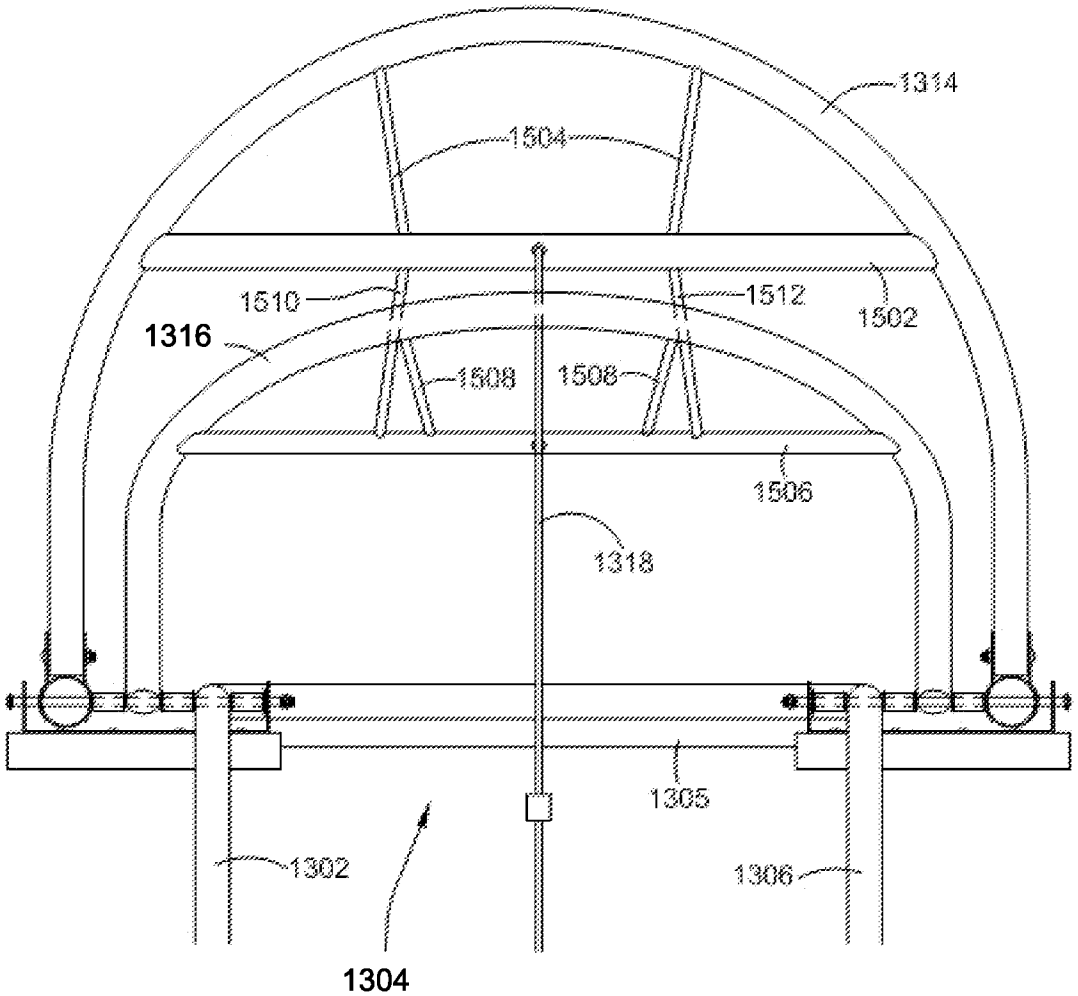
FIG. 15 illustrates a top view of the exemplary retractable ventilation dome of the hoop house of FIG. 13.

Referring now to FIG. 15, a top view of the exemplary retractable ventilation dome 1304 of the hoop house 1300 of FIG. 13 is illustrated. The retractable ventilation dome 1304 is shown in the extended position in FIG. 15. The base hoop 1314 further comprises a base hoop truss 1502. The base hoop truss 1502 can be a horizontal member which provides additional support for the base hoop 1314. According to various examples, the retraction member 1318 can be affixed to the base hoop truss 1502 and/or the base hoop 1314. Moreover, one or more truss supports 1504 connect the base hoop truss 1502 to the base hoop 1314.

The center hoop 1316 further includes a center hoop truss 1506. The center hoop truss 1506 can be a horizontal member which provides additional support for the center hoop 1316. According to various examples, the retraction member 1318 can be affixed to the center hoop truss 1506 and/or the center hoop 1316. Further, one or more truss supports 1508 connect the center hoop truss 1506 to the center hoop 1316.

The retractable ventilation dome 1304 can further include a first dome support 1510 rotationally affixed to the center hoop truss 1506 and removably affixed to the base hoop truss 1502. Moreover, the retractable ventilation dome 1304 can also include a second dome support 1512 rotationally affixed to the base hoop truss 1502 and removably affixed to the center hoop truss 1506. When the retractable dome 1304 is to be retracted, the first dome support 1510 can slide along the base hoop truss 1502 and rotate towards the center hoop truss 1506, and the second dome support 1512 can slide along the center hoop truss 1506 and rotate towards the base hoop truss 1502.

The retractable ventilation dome 1304 can be in the retracted position to provide ventilation for the hoop house (e.g., the hoop house 1300 of FIG. 13). Moreover, the retractable ventilation dome 1304 can be in the extended position to enclose the hoop house. Additionally, a shape of the retractable ventilation dome 1304 can provide resistance to wind shear forces (e.g., as compared to the end wall 1204 as shown in FIG. 12).

Figure 16:
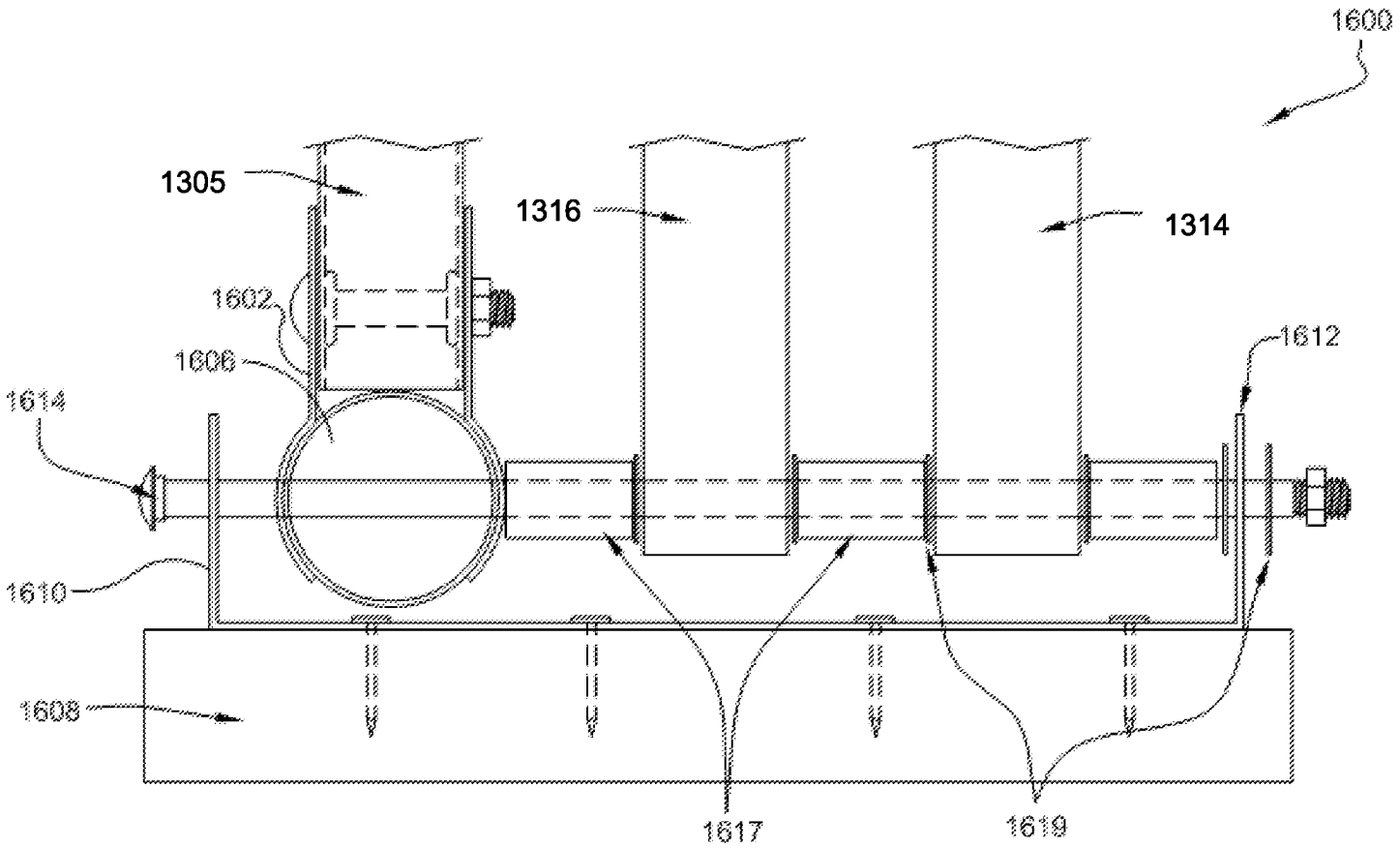
FIG. 16 illustrates a front cross-sectional view of an exemplary dome hinge for the retractable ventilation dome of the hoop house of FIG. 13.

While the example depicted in FIG. 15 illustrates the base hoop 1314 being larger than the center hoop 1316, and the center hoop 1316 being larger than the end hoop 1305, it is contemplated that alternatively the end hoop 1305 can be larger than the center hoop 1316, and the center hoop 1316 can be larger than the base hoop 1314 (e.g., similar to the examples shown in FIGS. 13 and 16). Thus, as noted below, differing respective positions of the end hoop 1305, the center hoop 1316, and the base hoop 1314 along a hinge rod are intended to fall within the scope of the hereto appended claims.

Referring now to FIG. 16, illustrated is a front cross-sectional view of an exemplary dome hinge 1600 for the retractable ventilation dome 1304 of the hoop house 1300 of FIG. 13. The dome hinge 1600 can be the first dome hinge 1306 or the second dome hinge 1310 of FIG. 13. The dome hinge 1600 can include (or be connected to) a hoop connector 1602 that can connect the end hoop 1305 to a horizontal member 1606 (e.g., the horizontal member 1308 or the horizontal member 1312 of FIG. 13). The dome hinge 1600 can include a hinge base 1608 perpendicular to the horizontal member 1606. The hinge base 1608 can include a first lip 1610 and a second lip 1612, where the first lip 1610 is opposite the second lip 1612. A hinge rod 1614 extends through the first lip 1610, the hoop connector 1602, the end hoop 1305, the center hoop 1316, the base hoop 1314, and the second lip 1612. Accordingly, the center hoop 1316 and the base hoop 1314 are rotatably engaged with the hinge rod 1614. Moreover, it is contemplated that other respective positions of the end hoop 1305, the center hoop 1316, and the base hoop 1314 along the hinge rod 1614 are intended to fall within the scope of the hereto appended claims.

The dome hinge 1600 can further include spacers 1617, washers 1619, etc. For instance, the spacers 1617 and the washers 1619 can position the base hoop 1314 and the center hoop 1316 along the hinge rod 1614 and/or engage the base hoop 1314 and the center hoop 1316 with the hinge rode 1614.

The hinge rod 1614 can be a threaded rod, a rod and bolt, a pin, or the like. The hinge base 1608 can be wood or steel or another suitable material. In some embodiments, a bracket comprises the first lip 1610 and the second lip 1612; accordingly, such bracket can be affixed to the hinge base 1608. For example, a steel bracket can be screwed or nailed into a wooden block to from the hinge base 1608; yet, the claimed subject matter is not limited to the foregoing example.

Figure 17:
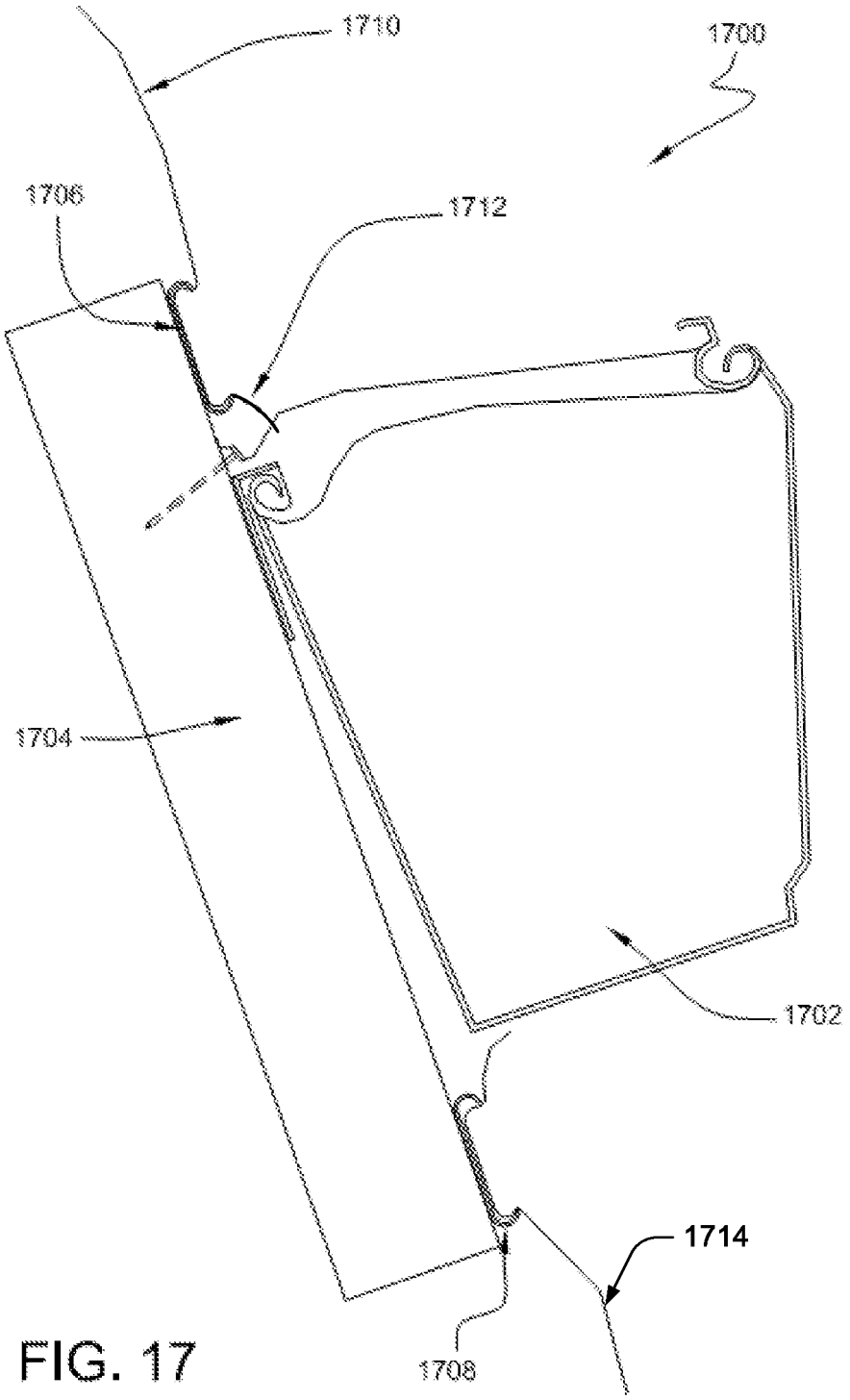
FIG. 17 illustrates a side cross-sectional view of an exemplary gutter system for a hoop house.

Referring now to FIG. 17, illustrated is a side cross-sectional view of an exemplary gutter system 1700 for a hoop house. The gutter system 1700 includes a gutter 1702 affixed to a side board 1704. The side board 1704 includes an upper channel bracket 1706 and a lower channel bracket 1708. A flexible roof 1710 can be wedged into the upper channel bracket 1706, such as by, for example, a wire, clip, or the like, such that an edge 1712 of the flexible roof 1710 extends into the gutter 1702. Thus, rainwater runoff can run from the flexible roof 1710 directly into the gutter 1702.

A flexible side 1714 is wedged into the lower channel bracket 1708, forming a secure connection between the flexible side 1714 and the gutter 1702. Accordingly, leakage into the hoop house can be mitigated.

In some embodiments, the flexible side 1714 may be a side-roll up. In other words, the flexible side 1714 can be rolled up from the ground by, for example, a crank attached to a member affixed to a bottom edge of the flexible side, etc., so as to provide variable ventilation around lower portions of the sides of the hoop house.

As hoop houses conventionally have a curved roof, rainwater runoff may accumulate, creating drainage and leakage issues, such as leakage around the bottom of a hoop house. Accordingly, the gutter system 1700 can mitigate the accumulation of rainwater runoff.

With reference now to FIGS. 18-21, various exemplary methodologies are illustrated and described. While the methodologies are described as being a series of acts that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

Figure 18:
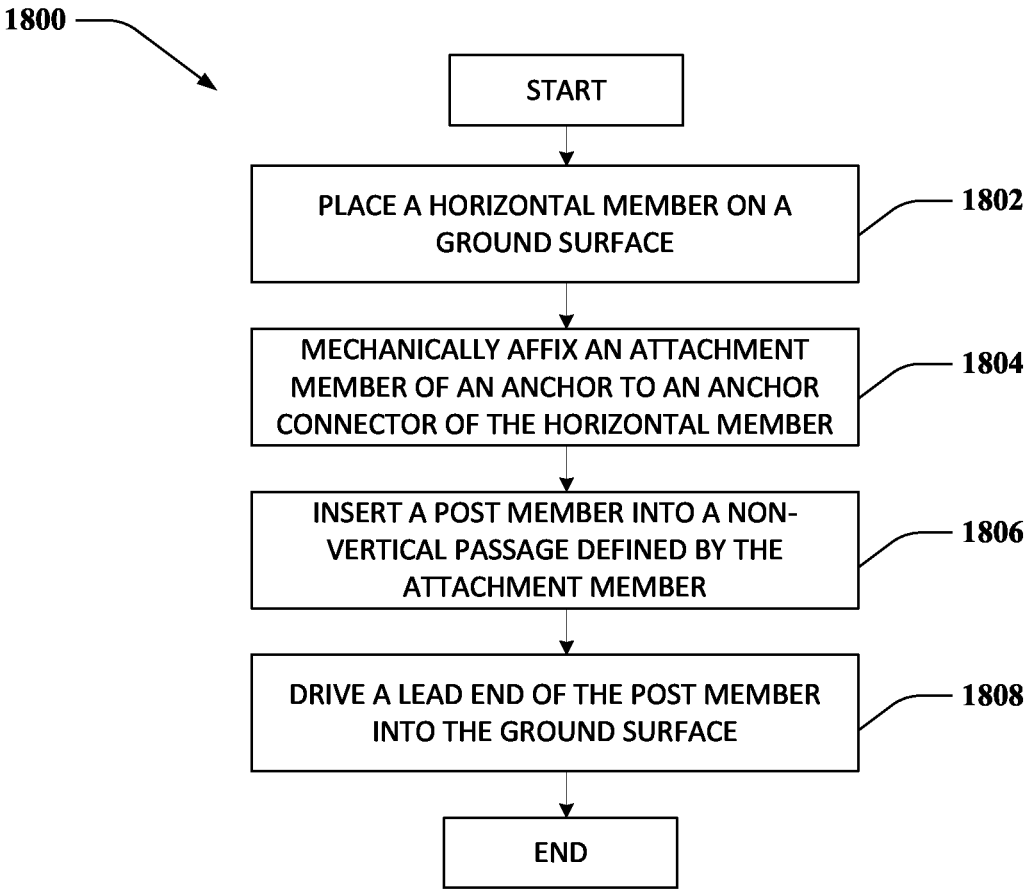
FIG. 18 is a flow diagram that illustrates an exemplary methodology of assembling an anchoring system for a hoop house.

Referring now to FIG. 18, a methodology 1800 of assembling an anchoring system for a hoop house is illustrated. At 1802, a horizontal member can be placed on a ground surface. At 1804, an attachment member of an anchor can be mechanically affixed to an anchor connector of the horizontal member. Moreover, the attachment member can define a non-vertical passage. At 1806, a post member can be inserted into the non-vertical passage. At 1808, a lead end of the post member can be driven into the ground surface.

Figure 19:
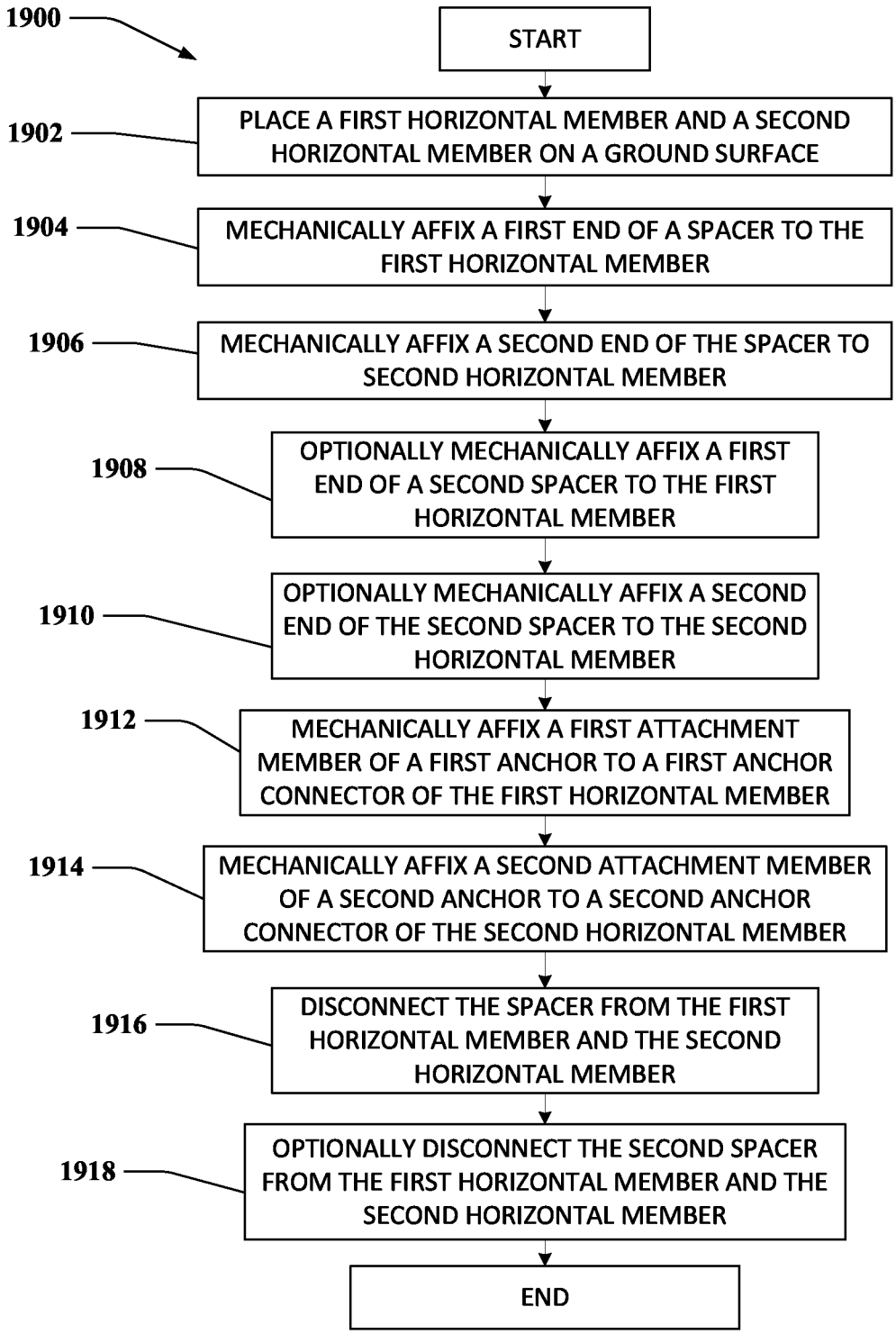
FIG. 19 is a flow diagram that illustrates another exemplary methodology of assembling an anchoring system for a hoop house.

Referring now to FIG. 19, another methodology 1900 of assembling an anchoring system for a hoop house is illustrated. At 1902, a first horizontal member and a second horizontal member can be placed on a ground surface. At 1904, a first end of a spacer can be mechanically affixed to the first horizontal member. At 1906, a second end of the spacer can be mechanically affixed to the second horizontal member, wherein the first end of the spacer and the second end of the spacer are at opposite ends of the spacer. Optionally, at 1908, a first end of a second spacer can be mechanically affixed to the first horizontal member. Optionally, at 1910, a second end of the second spacer can be mechanically affixed to the second horizontal member, wherein the first end of the second spacer and the second end of the second spacer are at opposite ends of the second spacer. At 1912, a first attachment member of a first anchor can be mechanically affixed to a first anchor connector of the first horizontal member. At 1914, a second attachment member of a second anchor can be mechanically affixed to a second anchor connector of the second horizontal member. At 1916, the spacer can be disconnected from the first horizontal member and the second horizontal member. Optionally, at 1918, the second spacer can be disconnected from the first horizontal member and the second horizontal member.

Figure 20:
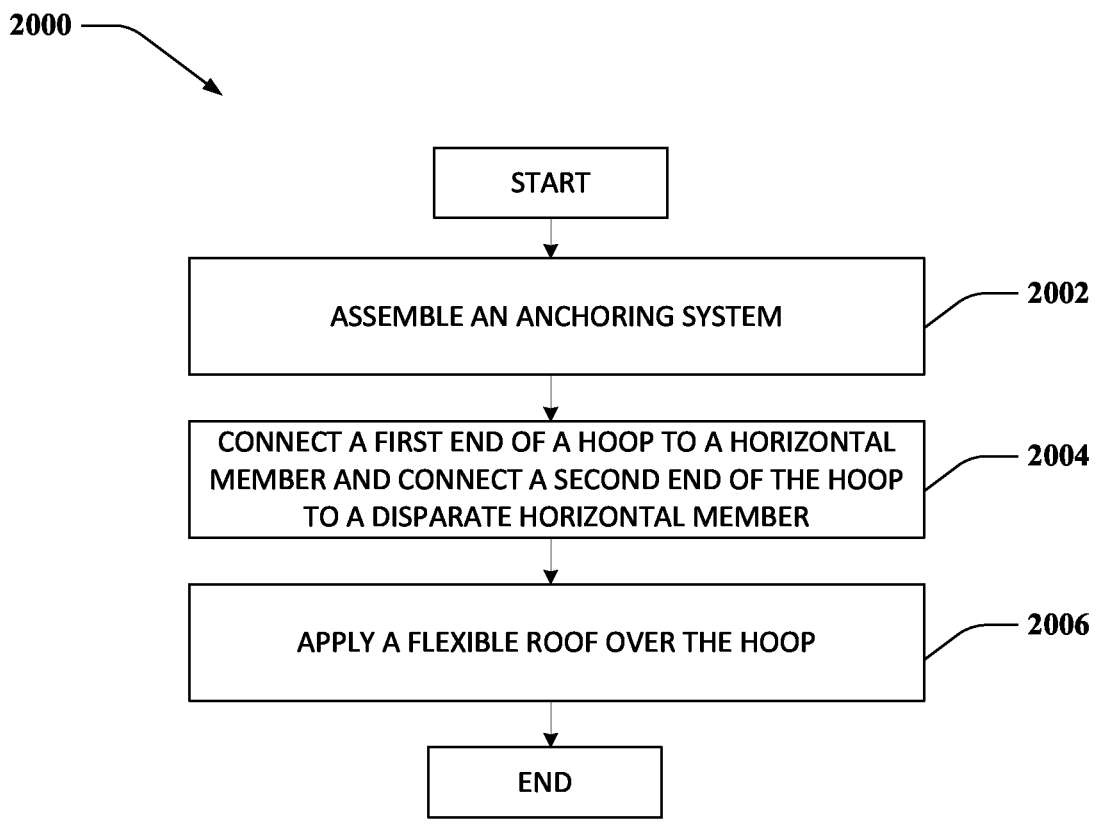
FIG. 20 is a flow diagram that illustrates an exemplary methodology of assembling a hoop house that includes an anchoring system.

Referring now to FIG. 20, a methodology 2000 of assembling a hoop house is illustrated. At 2002, an anchoring system can be assembled. At 2004, a first end of a hoop can be connected to a horizontal member and a second end of the hoop can be connected to a disparate horizontal member. At 2006, a flexible roof can be applied over the hoop.

Figure 21:
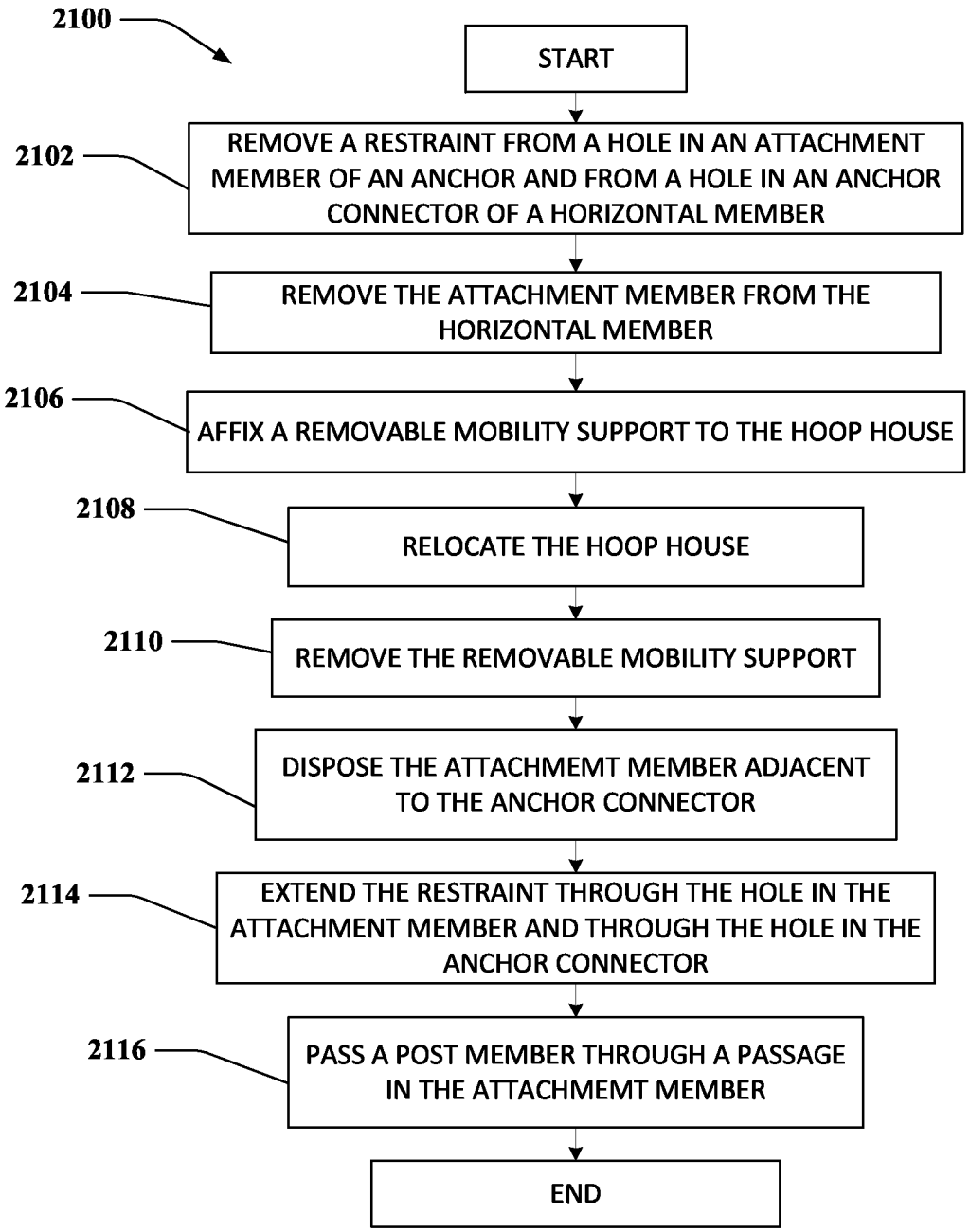
FIG. 21 is a flow diagram that illustrates an exemplary methodology of relocating a hoop house that includes an anchoring system.

Referring now to FIG. 21, a methodology 2100 for relocating an anchored hoop house is illustrated. At 2102, a restraint can be removed from a hole in an attachment member of an anchor and from a hole in an anchor connector of a horizontal member. At 2104, the attachment member can be removed from the horizontal member. At 2106, a removable mobility support can be affixed to the hoop house. At 2108, the hoop house can be relocated. In some embodiments, a post member can be removed from a ground surface at the original location. At 2110, the removable mobility support can be removed. At 2112, the attachment member can be disposed adjacent to the anchor attachment region. At 2114, the restraint can be extended through the hole in the attachment member and through the hole in the anchor attachment region. At 2116, the post member can be passed through a passage in the attachment member.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. An anchoring system for a hoop house, comprising:

a horizontal member, the horizontal member has a first passage there through;

a hoop connector configured to connect an end of a hoop to the horizontal member, the hoop connector comprising a first T-junction clamp shell and a second T-junction clamp shell, wherein the hoop is a non-linear support for a flexible roof of the hoop house;

an anchor, comprising:

an attachment member removably affixed to the horizontal member, the attachment member has a first hole there through, wherein the attachment member defines a second passage that comprises:

a first end of the second passage; and a second end of the second passage;

wherein the second end of the second passage is set off from the first end of the second passage by a vertical offset perpendicular to a linear axis of the horizontal member and a horizontal offset along the linear axis of the horizontal member in a first direction; and a first post member receivable within the second passage; and a restraint configured to pass through the first hole and the first passage to affix the attachment member to the horizontal member.

2. The anchoring system of claim 1, the attachment member of the anchor further comprises:

a first clamp grip, the first clamp grip has the first hole there through and defines the second passage; and a second clamp grip, wherein the first clamp grip and the second clamp grip are opposable, wherein the second clamp grip has a second hole there through, wherein the second clamp grip defines a third passage that comprises:

a first end of the third, passage; and a second end of the third passage;

wherein the second end of the third passage is set off from the first end of the third passage by the vertical offset and a horizontal offset along the linear axis of the horizontal member in a second direction opposite the first direction; and wherein the anchor further comprises a second post member receivable within the third passage; and wherein the restraint is further configured to pass through the second hole.

3. The anchoring system of claim 2, wherein a first inner surface of the first clamp grip defines a first concave cavity of the first clamp grip, and wherein a second inner surface of the second clamp grip defines a second concave cavity of the second clamp grip.

4. The anchoring system of claim 1, wherein the restraint comprises at least one of a threaded bolt, a bolt and nut, a rivet, or a tie.

5. The anchoring system of claim 1, wherein the second passage comprises a keyed cross-section, and wherein the first post member is keyed with respect to the keyed cross-section.

6. The anchoring system of claim 1, wherein the first T-junction clamp shell and the second T-junction clamp shell are opposable, and wherein the first T-junction clamp shell and the second T-junction clamp shell each comprise a respective interior surface that further comprises:

a first region that defines a horizontal cavity, wherein the horizontal member is receivable in the horizontal cavity; and a second region that defines a vertical cavity, wherein the end of the hoop is receivable in the vertical cavity, wherein the first region is contiguous with the second region, and wherein a hole passes through the second region of the interior surface; and wherein the hoop connector further comprises a hoop restraint configured to be positioned through the hole in the second region of the first T-junction clamp shell, a hole through the hoop, and the hole in the second region of the second T-junction clamp shell.

7. The anchoring system of claim 1, wherein the first passage through the horizontal member comprises a pair of holes through the horizontal member that are aligned.

8. The anchoring system of claim 1, further comprising:

a disparate horizontal member; and a disparate hoop connector configured to connect a second end of the hoop to the disparate horizontal member.

9. The anchoring system of claim 8, wherein the horizontal member further has a third passage there through, wherein the disparate horizontal member has a fourth passage and a fifth passage there through, wherein a second anchor is removably affixed to the horizontal member via the third passage, wherein a third anchor is removably affixed to the disparate horizontal member via the fourth passage, and wherein a fourth anchor is removably affixed to the disparate horizontal member via the fifth passage.

10. The anchoring system of claim 1, further comprising a removable mobility support that is removably affixed to the hoop house, wherein the removable mobility support is at least one of a wheel, a ski, a trolley, a trailer, a cart, or a truck bed.

11. The anchoring system of claim 1, further comprising:

a disparate horizontal member co-axial with the linear axis of the horizontal member, wherein the disparate horizontal member comprises:

a disparate hoop connector; and a horizontal member junction, wherein a first end of the horizontal member junction defines a first junction cavity and a second end of the horizontal member junction defines a second junction cavity, wherein the horizontal member is receivable in the first junction cavity, and wherein the disparate horizontal member is receivable in the second junction cavity.

12. The anchoring system of claim 11, wherein the horizontal member junction comprises a junction hoop connector configured to receive an end of a disparate hoop.

13. A hoop house, comprising:

a first horizontal member, comprising:

a first anchor connector; and a first hoop connector comprising a first T-junction clamp shell and a second T-junction clamp shell;

a second horizontal member, comprising:

a second anchor connector; and a second hoop connector comprising a third T-junction clamp shell and a fourth T-junction clamp shell;

a hoop comprising a first end and a second end, wherein the hoop is a non-linear support defining an interior of the hoop house, wherein the first end of the hoop is connected to the first hoop connector of the first horizontal member, and wherein the second end of the hoop is connected to the second hoop connector of the second horizontal member;

a flexible roof over the hoop;

a first anchor, comprising:

a first attachment member removably affixed to the first anchor connector of the first horizontal member, wherein the first attachment member comprises a first clamp grip and a second clamp grip;

a first passage comprising:

a first end of the first passage; and a second end of the first passage, wherein the second end of the first passage is set off from the first end of the first passage by a first vertical offset and a first horizontal offset along a first linear axis of the first horizontal member in a first direction; and a first post member receivable within the first passage; and a second anchor, comprising:

a second attachment member removably affixed to the second anchor connector of the second horizontal member, wherein the second attachment member comprises a third clamp grip and a fourth clamp grip;

a second passage comprising:

a first end of the second passage; and a second end of the second passage, wherein the second end of the second passage is set off from the first end of the second passage by a second vertical offset and a second horizontal offset along a second linear axis of the second horizontal member in a second direction; and a second post member receivable within the second passage.

14. A hoop house anchoring kit, comprising:

a first horizontal member that comprises a first anchor connector and a first hoop connector configured to receive a first end of a hoop, the first hoop connector comprising a first T-junction clamp shell and a second T-junction clamp shell, wherein the hoop is a non-linear support for a flexible roof of a hoop house;

a second horizontal member that comprises a second anchor connector and a second hoop connector configured to receive a second end of the hoop, the second hoop connector comprising a third T-junction clamp shell and a fourth T-junction clamp shell;

a first attachment member removably affixable to the first anchor connector, the first attachment member comprises a first diagonal passage and a second diagonal passage, wherein the first diagonal passage and the second diagonal passage have differing angles with respect to a linear axis of the first horizontal member when the first attachment member is affixed to the first horizontal member;

a second attachment member removably affixable to the second anchor connector, the second attachment member comprises a third diagonal passage and a fourth diagonal passage, wherein the third diagonal passage and the fourth diagonal passage have differing angles with respect to a linear axis of the second horizontal member when the second attachment member is affixed to the second horizontal member;

a first post member configured to be receivable within the first diagonal passage;

a second post member configured to be receivable within the second diagonal passage;

a third post member configured to be receivable within the third diagonal passage; and a fourth post member configured to be receivable within the fourth diagonal passage.

15. The hoop house anchoring kit of claim 14, further comprising a removable mobility support removably affixable to at least one of the first anchor connector or the second anchor connector.

16. An anchoring system for a hoop house, comprising:

a horizontal member, comprising:

an anchor connector; and a hoop connector configured to connect an end of a hoop to the horizontal member, wherein the hoop is a non-linear support for a flexible roof of the hoop house;

an anchor, comprising:

an attachment member removably affixed to the anchor connector of the horizontal member, the attachment member comprising a first clamp grip and a second clamp grip that are opposable, a first inner surface of the first clamp grip defines a first concave cavity of the first clamp grip, and a second inner surface of the second clamp grip defines a second concave cavity of the second clamp grip, wherein the attachment member defines a passage that comprises:

a first end of the passage; and a second end of the passage;

wherein the second end of the passage is set off from the first end of the passage by a vertical offset perpendicular to a linear axis of the horizontal member and a horizontal offset along the linear axis of the horizontal member in a first direction; and a post member receivable within the first passage.

17. The anchoring system of claim 16, wherein:

the first clamp grip comprises a first hole through the first clamp grip and the passage;

the second clamp grip comprises a second hole through the second clamp grip and a second passage, the second passage comprising:

a first end of the second passage; and a second end of the second passage;

wherein the second end of the second passage is set off from the first end of the second passage by the vertical offset and by a horizontal offset along the linear axis of the horizontal member in a second direction opposite the first direction; and the anchor further comprises:

a second post member receivable within the second passage; and a restraint configured to be extended through the first hole in the first clamp grip, the anchor connector of the horizontal member, and the second hole in the second clamp grip.

18. The anchoring system of claim 16, wherein the hoop connector comprises:

a first T-junction clamp shell and a second T-junction clamp shell, wherein the first T-junction clamp shell and the second T-junction clamp shell are opposable, and wherein the first T-junction clamp shell and the second T-junction clamp shell each comprise a respective interior surface that further comprises:

a first region that defines a horizontal cavity, wherein the horizontal member is receivable in the horizontal cavity; and a second region that defines a vertical cavity, wherein the end of the hoop is receivable in the vertical cavity, wherein the first region is contiguous with the second region, and wherein a hole passes through the second region of the interior surface; and a hoop restraint configured to be positioned through the hole in the second region of the first T-junction clamp shell, a hole through the hoop, and the hole in the second region of the second T-junction clamp shell.

19. The anchoring system of claim 16, further comprising:

a disparate horizontal member co-axial with the linear axis of the horizontal member, wherein the disparate horizontal member comprises:

a disparate anchor connector; and a disparate hoop connector; and a horizontal member junction, wherein a first end of the horizontal member junction defines a first junction cavity and a second end of the horizontal member junction defines a second junction cavity, wherein the horizontal member is receivable in the first junction cavity, and wherein the disparate horizontal member is receivable in the second junction cavity.

* * * * *